US011672337B1

(12) United States Patent
Clayton

(10) Patent No.: US 11,672,337 B1
(45) Date of Patent: Jun. 13, 2023

(54) PIVOTABLE SHELVING SYSTEM

(71) Applicant: Dennis Clayton, Vonore, TN (US)

(72) Inventor: Dennis Clayton, Vonore, TN (US)

( * ) Notice: Subject to any disclaimer, the term of this patent is extended or adjusted under 35 U.S.C. 154(b) by 0 days.

(21) Appl. No.: 16/846,323

(22) Filed: Apr. 11, 2020

Related U.S. Application Data

(60) Provisional application No. 62/832,702, filed on Apr. 11, 2019.

(51) Int. Cl.
*A47B 49/00* (2006.01)
*A47B 96/02* (2006.01)

(52) U.S. Cl.
CPC ..... *A47B 49/004* (2013.01); *A47B 96/021* (2013.01); *A47B 96/025* (2013.01)

(58) Field of Classification Search
CPC ..... A47B 49/004; A47B 49/00; A47B 96/025; A47B 63/062; A47B 81/005; A47B 49/006; A47B 46/00; A47B 81/002; A47B 77/10; A47B 49/002; A47B 2063/005; A47B 87/0223; A47B 31/00; A47B 96/021; A47F 5/02; A47F 5/05; A47F 5/0087; A47F 5/04; A47F 5/0037; A47F 3/10; A47F 7/0028; A47F 7/0021; B25H 3/025
USPC ..... 312/202; 211/144, 163, 70, 60.1
See application file for complete search history.

(56) References Cited

U.S. PATENT DOCUMENTS 353,419 A * 11/1886 Lamson ..... A47F 3/10 312/135
2,239,734 A * 4/1941 Pratt ..... A47B 49/004 312/238
2,856,255 A * 10/1958 Doesken ..... A47B 49/004 312/319.8
2,905,518 A * 9/1959 Doesken ..... A47B 49/008 312/319.6
3,188,159 A * 6/1965 Wenger ..... A47B 49/004 312/305
3,858,529 A * 1/1975 Salladay ..... A47B 49/004 108/103
4,380,296 A * 4/1983 Murray ..... A47F 7/005 211/10
4,632,474 A * 12/1986 Ingersoll ..... A47F 7/02 312/125
4,639,051 A * 1/1987 DeBruyn ..... A47B 96/16 312/275
4,738,495 A * 4/1988 Mitts ..... A47B 49/006 108/140
4,850,658 A * 7/1989 Sandor ..... A47F 5/02 211/85.2
5,024,168 A * 6/1991 Stravitz ..... A47B 49/004 108/20
5,074,421 A * 12/1991 Coulter ..... A47F 5/02 211/163

(Continued)

*Primary Examiner* — Hiwot E Tefera
(74) *Attorney, Agent, or Firm* — Michael J. Bootcheck, LLC; Michael J. Bootcheck

(57) ABSTRACT

The present invention is for a novel pivotable shelving system utilizing (in some embodiments) one or more D-shaped shelves that may pivot such that when it is in a cabinet and the flat portion of the D shape is at a front edge of the cabinet, when the shelf is rotated, a portion of the shelf extends beyond the front of the cabinet. Other improvements in some embodiments include devices having multiple swiveling spinners which may each operate/pivot independently as well as multiple shelves of varied geometry to enable taller items to be placed on the lower shelf and extent above an upper shelf.

14 Claims, 47 Drawing Sheets

(56) References Cited

U.S. PATENT DOCUMENTS

| | | | | | |
|---|---|---|---|---|---|
| 5,547,085 | A * | 8/1996 | Gaus | A47B 81/068 | 211/163 |
| 5,664,852 | A * | 9/1997 | Robinson | A47B 46/00 | 312/140.4 |
| 5,979,677 | A * | 11/1999 | Simpson, II | A63H 3/52 | 211/13.1 |
| 8,272,519 | B1 * | 9/2012 | Rekhels | A47F 5/02 | 211/163 |
| 8,915,391 | B2 * | 12/2014 | Radow | A47G 19/00 | 220/23.83 |
| 9,198,511 | B2 * | 12/2015 | Pendleton | A47B 49/004 | |
| 9,198,512 | B1 * | 12/2015 | Moayeri | A47B 55/00 | |
| 2002/0162812 | A1 * | 11/2002 | Humphrey | A47F 5/02 | 211/85.14 |
| 2003/0155317 | A1 * | 8/2003 | McNeeley | A47B 49/00 | 211/78 |
| 2003/0173321 | A1 * | 9/2003 | Craft | A47B 81/002 | 211/144 |
| 2003/0196978 | A1 * | 10/2003 | Humphrey | A47F 5/02 | 211/163 |
| 2009/0230069 | A1 * | 9/2009 | Naden | A47B 96/025 | 211/144 |

* cited by examiner

LSCA/GC
22
10
D/2
D
14
16
22
18
AXIS/CH

CH
22

10
24
22
26
SSW/2
SSW

10

10

PIVOTABLE SHELVING SYSTEM

CROSS-REFERENCE TO RELATED APPLICATIONS

This application claims priority from U.S. Provisional Application Ser. No. 62/832,702 filed 11 Apr. 2019, which is titled "PIVOTABLE SHELING SYSTEM", which is hereby incorporated in its entirety by reference.

FIELD OF THE INVENTION

The present invention is for a novel revolving shelf/tray which can be placed into a cabinet (or on another surface) often used for holding condiments or other small articles (i.e., "lazy susan" type rotatable tray) that in some embodiments allows the tray to partially extend beyond the cabinet front when it is rotated into an "open"/"extended" position whereas it is completely behind the front of the cabinet when in a "closed"/"retracted" position.

BACKGROUND OF THE INVENTION

Every home, office, and just about every other building/space has at least one cabinet and almost all of these cabinets limit a user to easy access to only the front contents of the cabinet. Several products have been made available to the public over the last few years that provide a revolving shelf/tray that can be placed into the cabinet. When goods are placed on the surface the shelf can be rotated so that the user can reach goods that weren't originally toward the front of the cabinet. Unfortunately, none of these devices provided easy access which extends forward of the front of the cabinet. What is needed is a device which can extend outward from the front of the cabinet. What is also needed is a device with two or more shelves and an ability to independently rotate some of the items on a shelf whereas other items do not have to rotate at the same time. What is further needed is an ability to place items of varying heights onto the lower shelf of such a device.

In one embodiment, the device comprises a lower shelf having a lower shelf top surface and a lower shelf bottom surface, a first swiveling spinner connected to the lower shelf bottom surface allowing the lower shelf to be pivoted about a first swiveling spinner axis and a second swiveling spinner.

In another embodiment, the device comprises a lower shelf having a lower shelf top surface and a lower shelf bottom surface, a first swiveling spinner connected to the lower shelf bottom surface allowing the lower shelf to be pivoted about a first swiveling spinner axis and a second swiveling spinner and the second swiveling spinner is located on the lower shelf top surface.

In another embodiment, the device comprises a lower shelf having a lower shelf top surface and a lower shelf bottom surface, a first swiveling spinner connected to the lower shelf bottom surface allowing the lower shelf to be pivoted about a first swiveling spinner axis and at least one upper shelf above the lower shelf.

In another embodiment, the device comprises a lower shelf having a lower shelf top surface and a lower shelf bottom surface, a first swiveling spinner connected to the lower shelf bottom surface allowing the lower shelf to be pivoted about a first swiveling spinner axis and at least one upper shelf above the lower shelf, and at least one of the at least one upper shelf has at least one opening.

SUMMARY OF THE INVENTION

The present invention is directed to a novel revolving shelf/tray which can be placed into a cabinet (or on another surface) often used for holding condiments and spices (i.e., "lazy susan" type rotatable tray) that allows the tray to partially extend beyond the cabinet front when it is rotated into an "open"/"extended" position whereas it is completely behind the front of the cabinet when in a "closed"/"retracted" position. Various embodiments may have multiple swiveling spinners and multiple shelves such that there may be more than one spinner and various shelf shapes.

BRIEF DESCRIPTION OF THE FIGURES

FIG. 7 illustrates a bottom view of the exemplary embodiment of FIGS. 1-6;

FIG. 70 illustrates a perspective view of an exemplary embodiment of the present invention showing an exemplary two shelf embodiment;

FIG. 72 illustrates a perspective view of an exemplary embodiment of the present invention showing an exemplary two shelf embodiment.

DETAILED DESCRIPTION OF THE INVENTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

Figure 1:
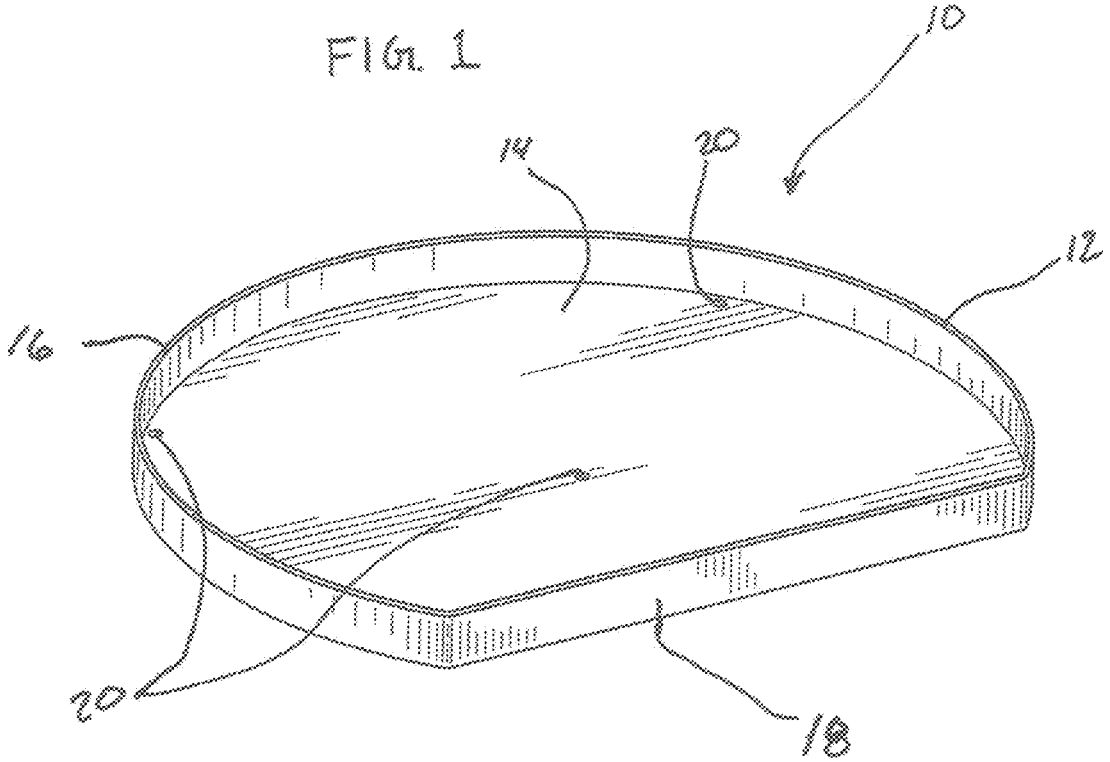
FIG. 1 illustrates a perspective view of an exemplary embodiment of the present invention showing an exemplary single shelf embodiment.
Figure 29:
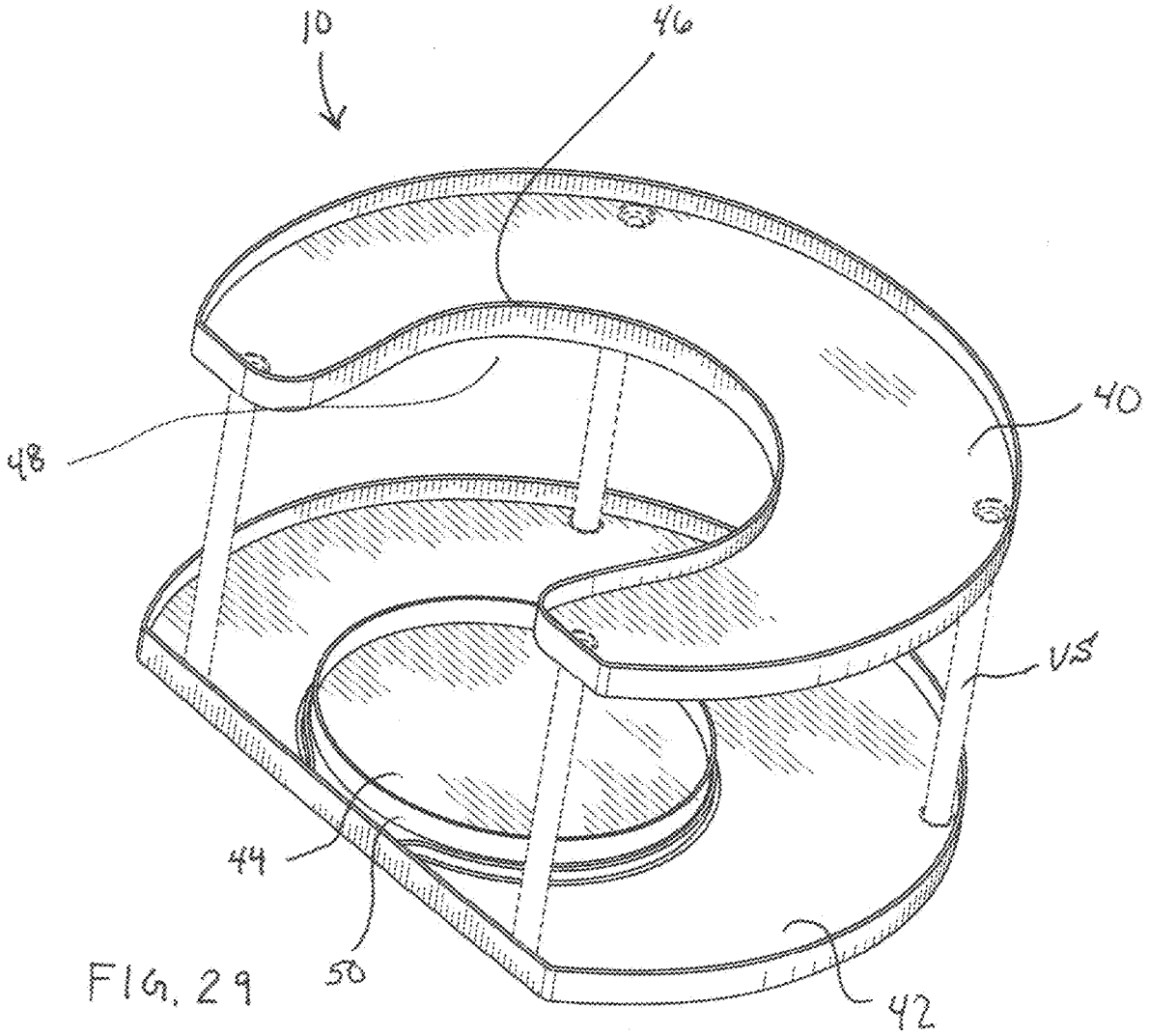
FIG. 29 illustrates a perspective view of an exemplary embodiment of the present invention showing an exemplary two shelf embodiment.

FIG. 1 illustrates a perspective view of an exemplary embodiment of the present invention showing an exemplary tray/lower shelf 10, walled structure 12, lower shelf 42 (see also FIG. 29, top inner surface/lower shelf top surface 14, vertical curved (curved part of "D shape") sidewall/vertical curved portion 16, flat front wall (flat part of "D shape")/flat front wall portion 18, optional holes 20 (which can accommodate screws to attach various components to each other), and optional feet/bumpers 22.

This embodiment illustrates shelf/tray 10 which can be placed into a cabinet (or on another surface) (not shown) often used for holding condiments or other articles (i.e., "lazy susan" type rotatable tray) that allows the tray to partially extend beyond the cabinet front when it is rotated into an "open"/"extended" position whereas it is completely behind the front of the cabinet when in a "closed"/"retracted" position. The tray is able to extend "forward" due to it's geometric "D" shape such that when the flat part of the "D" of the tray is toward the front of the cabinet, the tray is designed to spin about the center of the tray as if it was complete circle shaped, thus, when the flat/straight part of the tray is initially at the front edge/surface of a cabinet, when the tray is rotated, a rounded portion of the "D" shape will then be forward such that it will present a portion of the tray which is "forward" of where the tray initially extended. An arc can be defined for a circular tray in which the same radius extends to all edges of the tray. In the present invention, the same center point is used/defined, but the arc/edge of the tray is not uniform at a consistent radius. In the present invention, the curved portion does not extend over all 360 degrees of the circle, instead the curved portion extends, in some embodiments, for 270 degrees. In such embodiments, the remaining portion is "flattened" such that a flat surface connects these points of the tray to present a "D" shaped tray as illustrated in various figures. In other embodiments, the arced portion extends over an arc of up to 320 degrees. In other embodiments, the arced portion extends over an arc of up to 220 degrees. In other embodiments, the arced portion extends over an arc of between 240 degrees and 265 degrees. The arc angle illustrated in FIG. 6 provides a good balance between storage area for articles and ability for the tray to extend outwardly from a cabinet when pivoted to an extended position.

Figure 2:
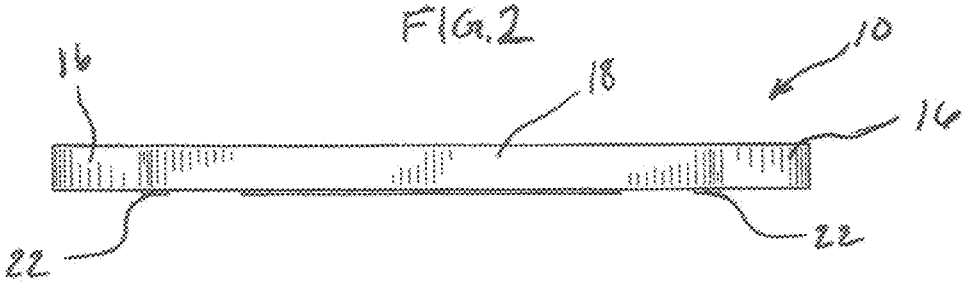
FIG. 2 illustrates a front view of the exemplary embodiment of FIG. 1.
Figure 3:
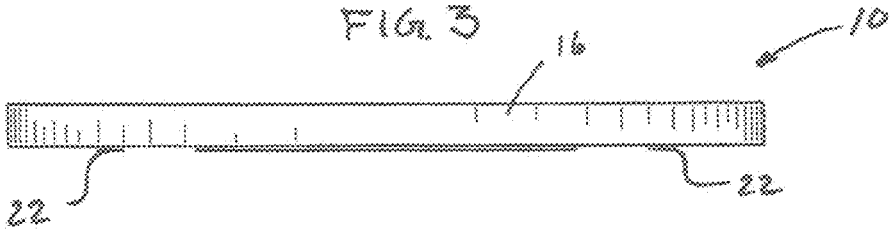
FIG. 3 illustrates a rear view of the exemplary embodiment of FIGS. 1-2.
Figure 4:
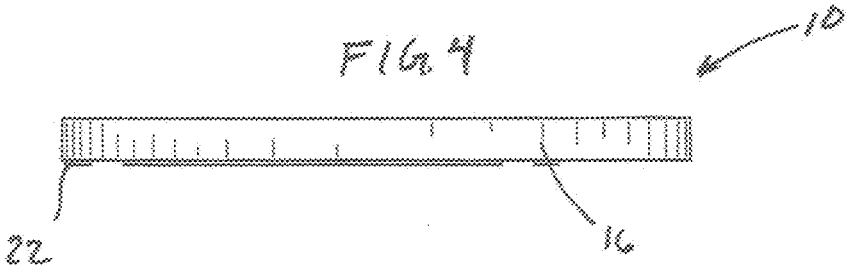
FIG. 4 illustrates a first side view of the exemplary embodiment of FIGS. 1-3.
Figure 5:
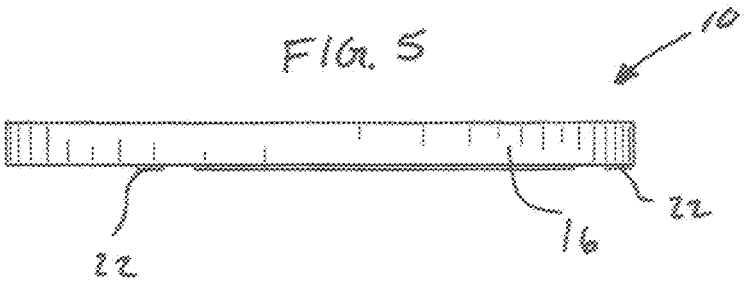
FIG. 5 illustrates a second side view of the exemplary embodiment of FIGS. 1-4.

FIG. 2 illustrates a front view of the exemplary embodiment of FIG. 1. FIG. 3 illustrates a rear view of the exemplary embodiment of FIGS. 1-2. FIG. 4 illustrates a first side view of the exemplary embodiment of FIGS. 1-3. FIG. 5 illustrates a second side view of the exemplary embodiment of FIGS. 1-4.

Figure 6:
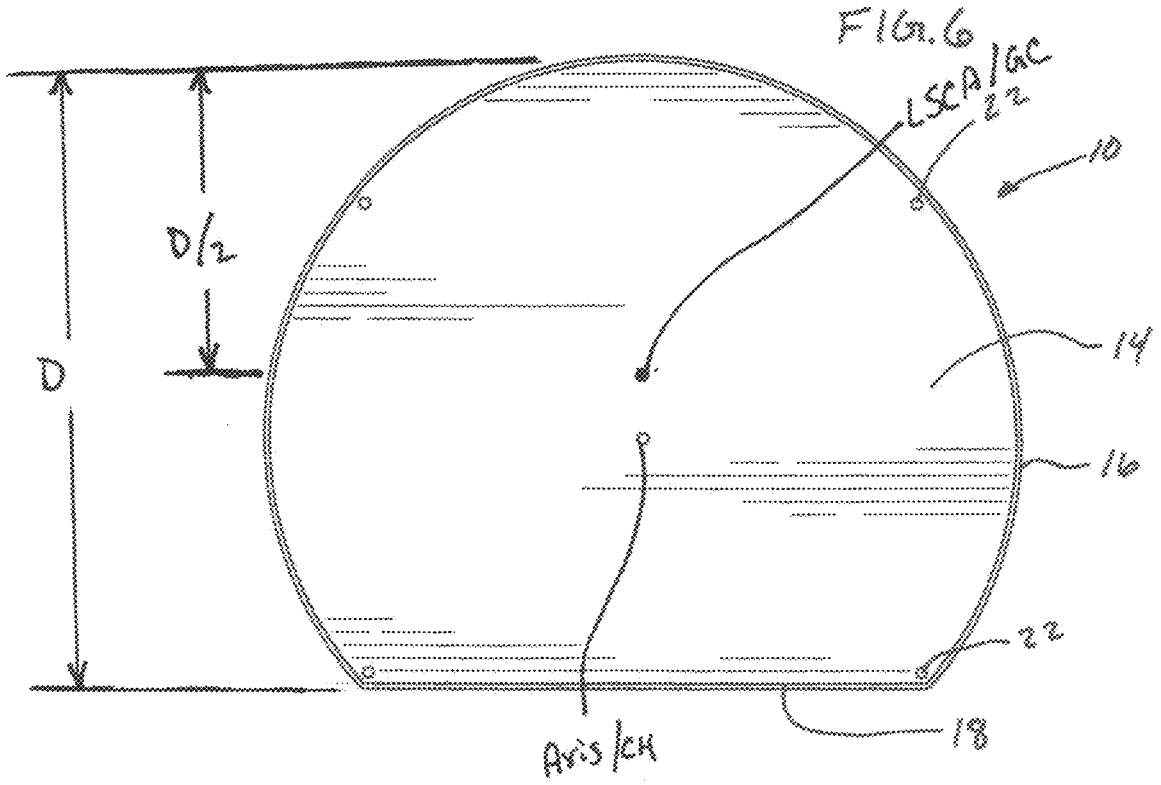
FIG. 6 illustrates a top view of the exemplary embodiment of FIGS. 1-5.

FIG. 6 illustrates a top view of the exemplary embodiment of FIGS. 1-5. Lower shelf 10 is be pivotable about a vertical axis VA (an axis though the center of hole CH (see also FIG. 7). In this embodiment, lower shelf 10 has geometric center GC and a lower shelf axis LSCA through the geometric center GC of the lower shelf (located one half of the distance measured from a front of the lower shelf to a rear of the lower shelf ("D" and, thus, "D/2") and one half of the distance between a right hand end of the lower shelf and a left hand end of the lower shelf (SSW and SSW/2, respectively). In this embodiment, the first swiveling spinner axis VA is not coaxial with said lower shelf axis LSCA.

FIG. 7 illustrates a bottom view of the exemplary embodiment of FIGS. 1-6. Illustrated in this figure is an optional raised portion 24 which may provide an additional support/anchor for a pivoting means/swiveling spinner. Bottom surface 26 of tray 10 is also shown.

Figure 8:
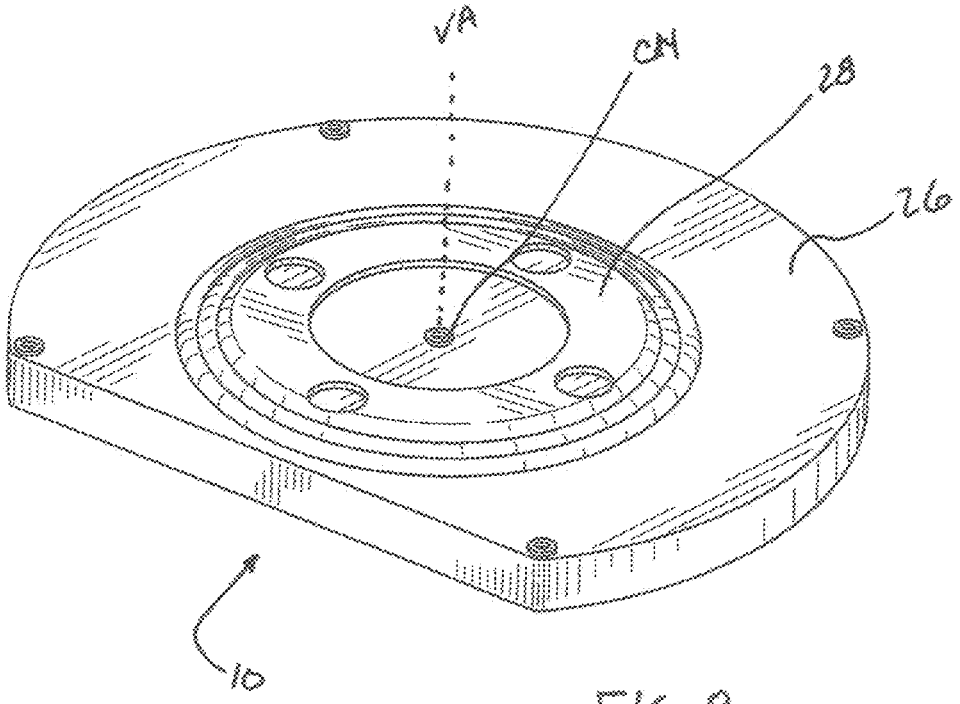
FIG. 8 illustrates a bottom/underside perspective view of an exemplary embodiment of the present invention showing an exemplary single shelf embodiment with pivoting/rotating means/spinner.
Figure 9:
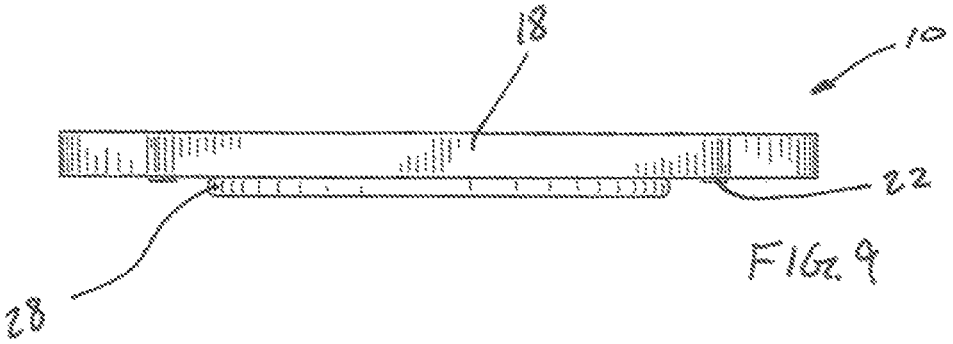

FIG. 8 illustrates a bottom/underside perspective view of an exemplary embodiment of the present invention showing an exemplary single shelf embodiment with pivoting/rotating means/first swiveling spinner 28. In this embodiment, pivoting/rotating/swivel means/spinner 28 is included on the bottom of tray 10 to permit tray 10 to be pivotable about a vertical axis VA (an axis though the center of hole CH in FIG. 14) through the center of curvature of the arc illustrated when tray 10 is viewed from above (or below). The swivel means/spinner may include a number of ball bearings positioned (and restrained) between two plates, although other swiveling means may also be incorporated and utilized to swivel the tray. In some embodiments, the swivel means may be of a galvanized material to allow for a long and durable life of the device/means.

Figure 9:
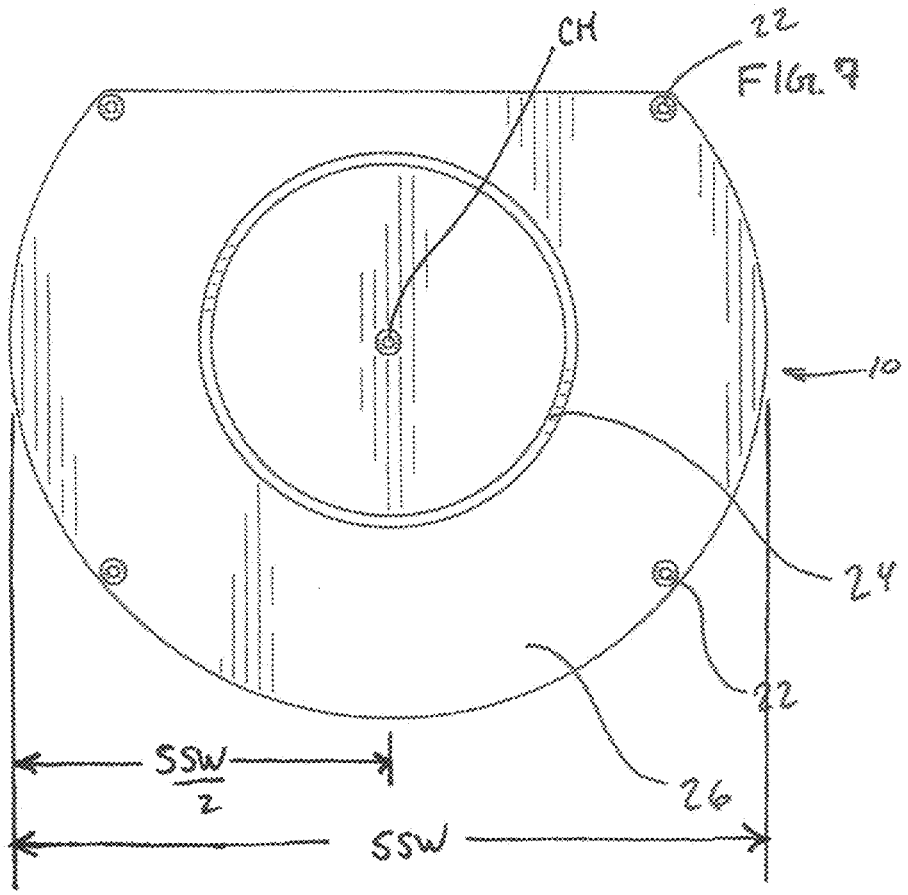
FIG. 9 illustrates a front view of the exemplary embodiment of FIG. 8.
Figure 10:
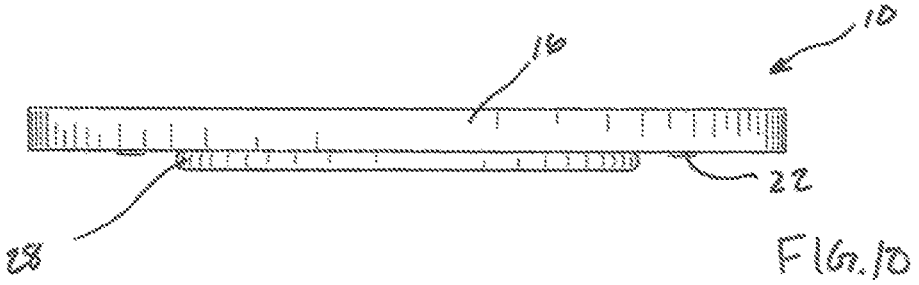
FIG. 10 illustrates a rear view of the exemplary embodiment of FIGS. 8-9.
Figure 11:
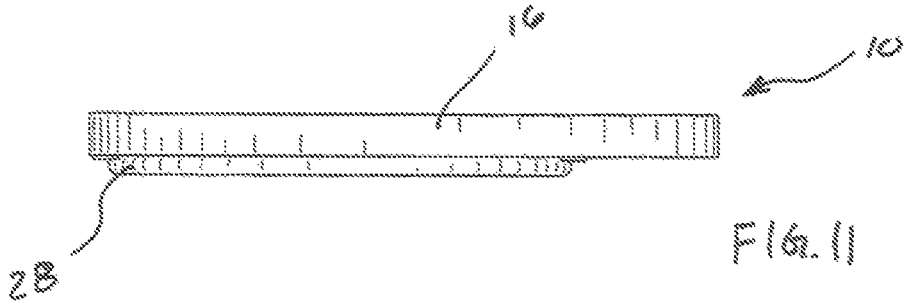
FIG. 11 illustrates a first side view of the exemplary embodiment of FIGS. 8-10.
Figure 12:
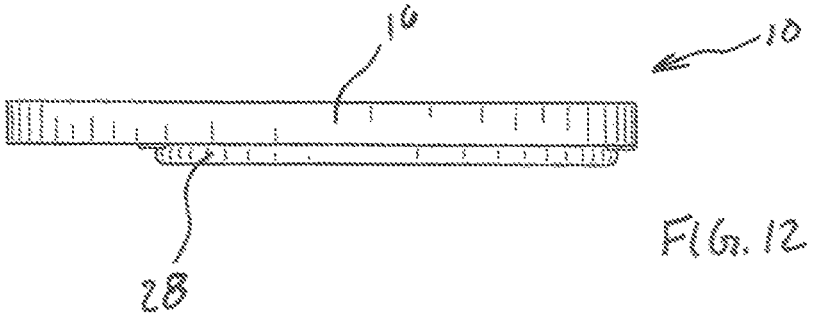
FIG. 12 illustrates a second side view of the exemplary embodiment of FIGS. 8-11.
Figure 13:
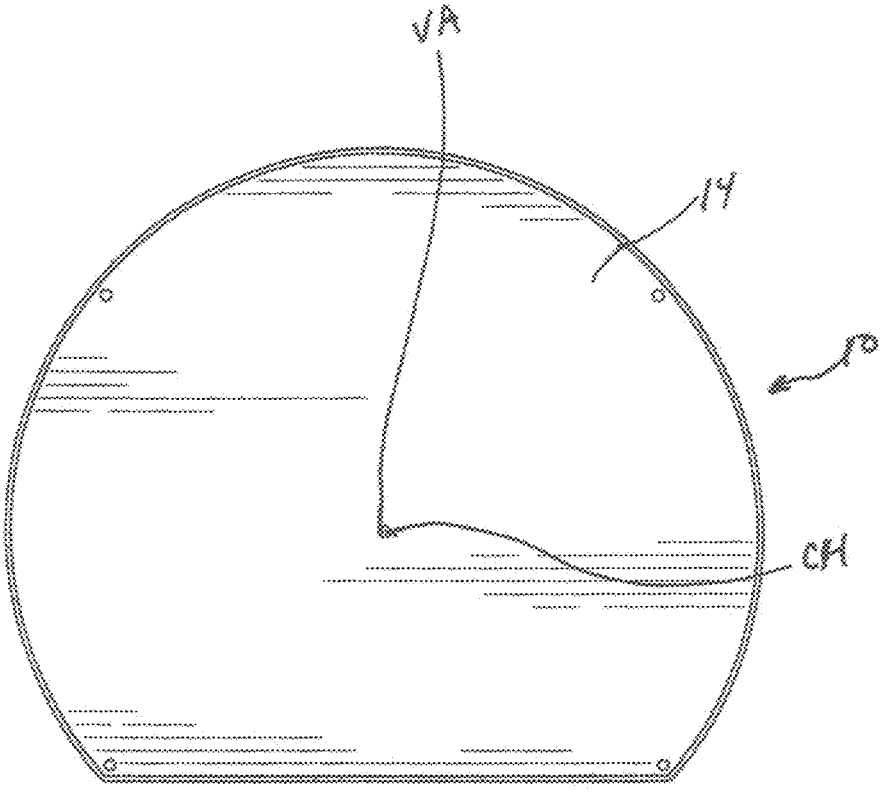
FIG. 13 illustrates a top view of the exemplary embodiment of FIGS. 8-12.

FIG. 9 illustrates a front view of the exemplary embodiment of FIG. 8. FIG. 10 illustrates a rear view of the exemplary embodiment of FIGS. 8-9. FIG. 11 illustrates a first side view of the exemplary embodiment of FIGS. 8-10. FIG. 12 illustrates a second side view of the exemplary embodiment of FIGS. 8-11. FIG. 13 illustrates a top view of the exemplary embodiment of FIGS. 8-12.

Figure 14:
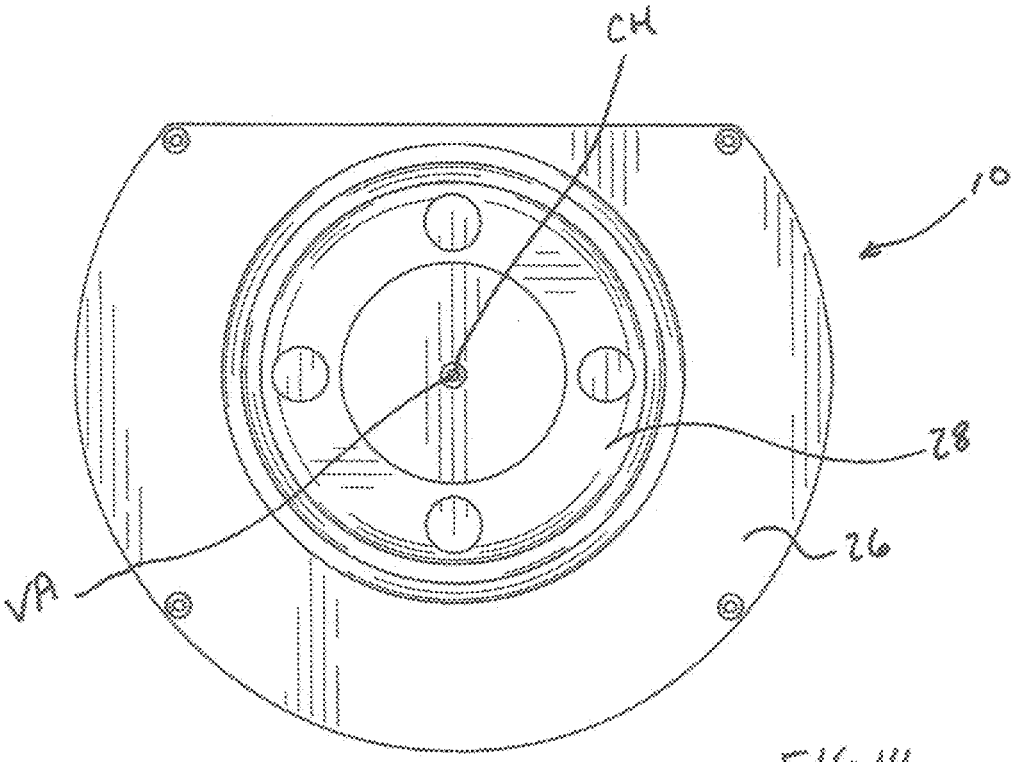
FIG. 14 illustrates a bottom view of the exemplary embodiment of FIGS. 8-13.

FIG. 14 illustrates a bottom view of the exemplary embodiment of FIGS. 8-13. An axis VA through the center of center hole CH located in the swivel means is the central axis/vertical axis VA referred to above. Note that although the swivel means is illustrated as having several holes therein, these are merely design options and not required.

Figure 15:
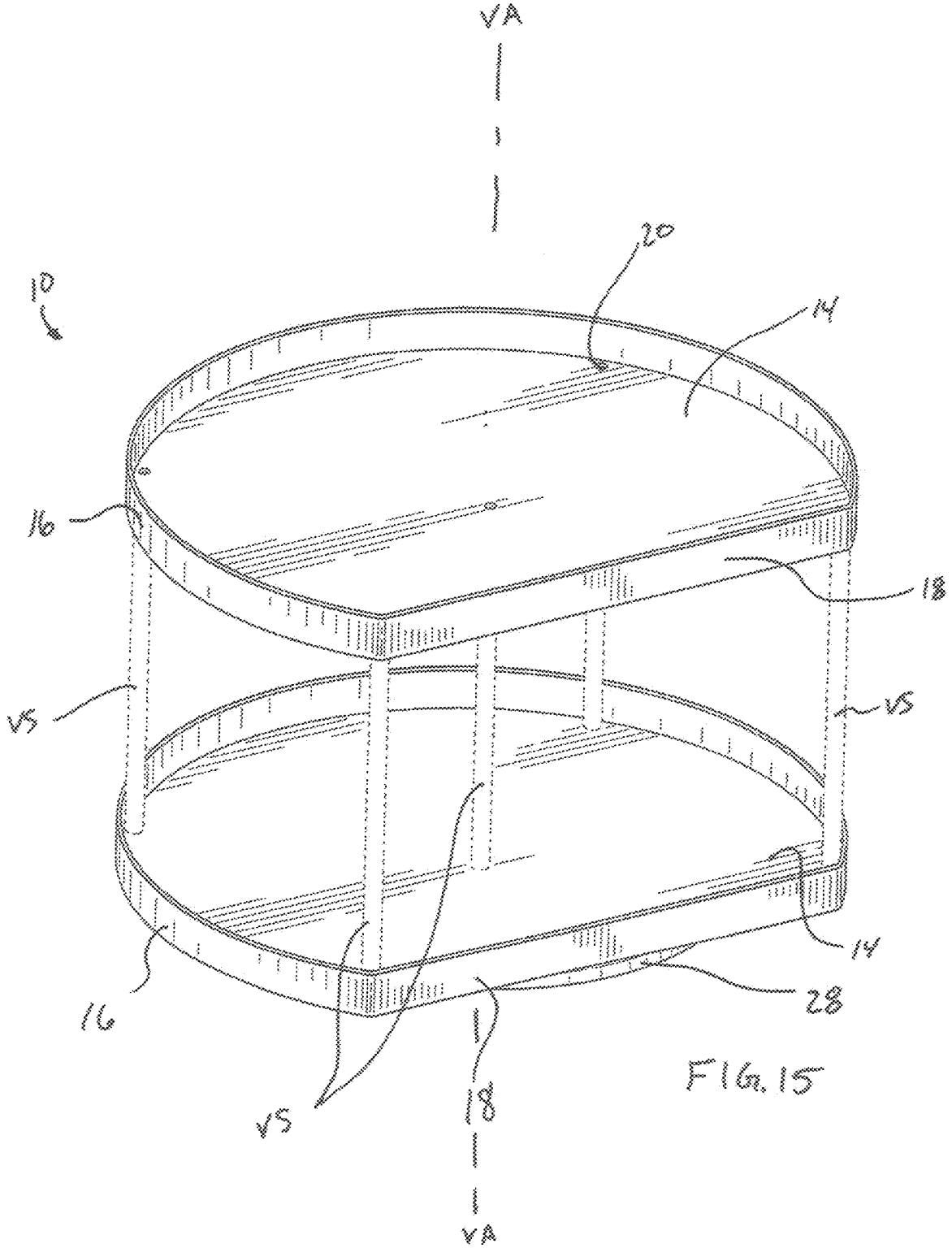
FIG. 15 illustrates a perspective view of an exemplary embodiment of the present invention showing an exemplary two shelf embodiment.

FIG. 15 illustrates a perspective view of an exemplary embodiment of the present invention showing an exemplary two shelf embodiment, lower shelf and an upper shelf. This embodiment includes two shelves and a number of vertical supports VS which maintain a fixed relationship between the shelves. The number of vertical supports VS is variable and in some embodiments the number of supports is three or more. In the illustrated embodiment, there are five vertical supports with one occurring in line along vertical axis VA. Such orientation is not strictly required however, it is preferred that the number (and configuration/material choice) of the supports is sufficient to hold the articles desired for the particular use. In this embodiment, only the lower tray has a swivel means. In some embodiments, each tray may have its' own independent swivel means so that the trays may be pivoted independently. In embodiments with independent swivel means, the central axis of the swiveling means should be coaxial with each other to maintain stability of device 10. In some embodiments there may be a single vertical support VS which should be along vertical axis VA.

Figure 16:
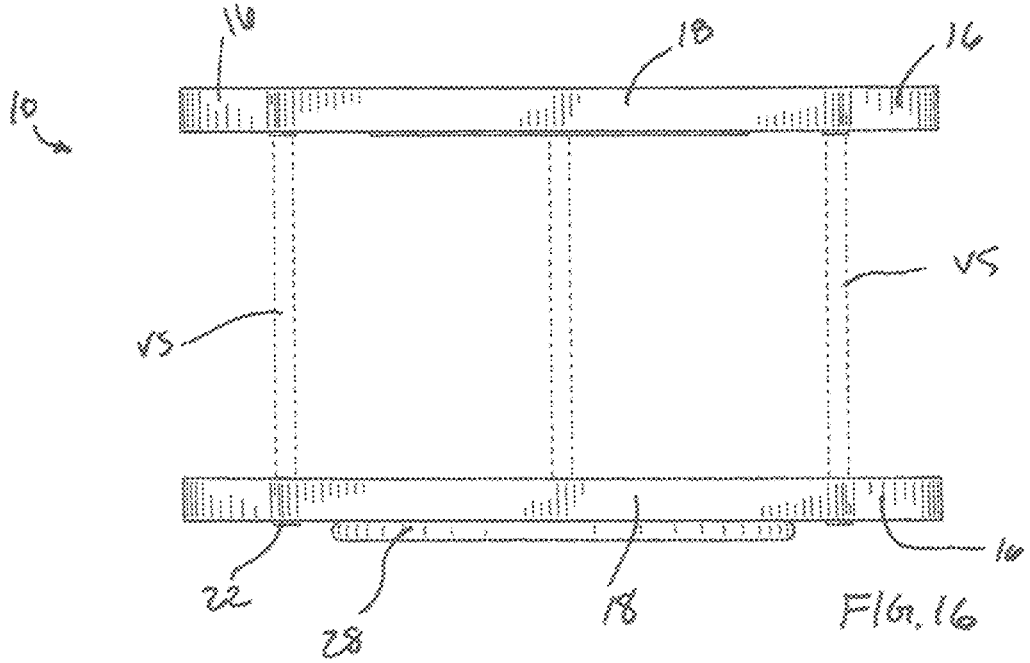
FIG. 16 illustrates a front view of the exemplary embodiment of FIG. 15.
Figure 17:
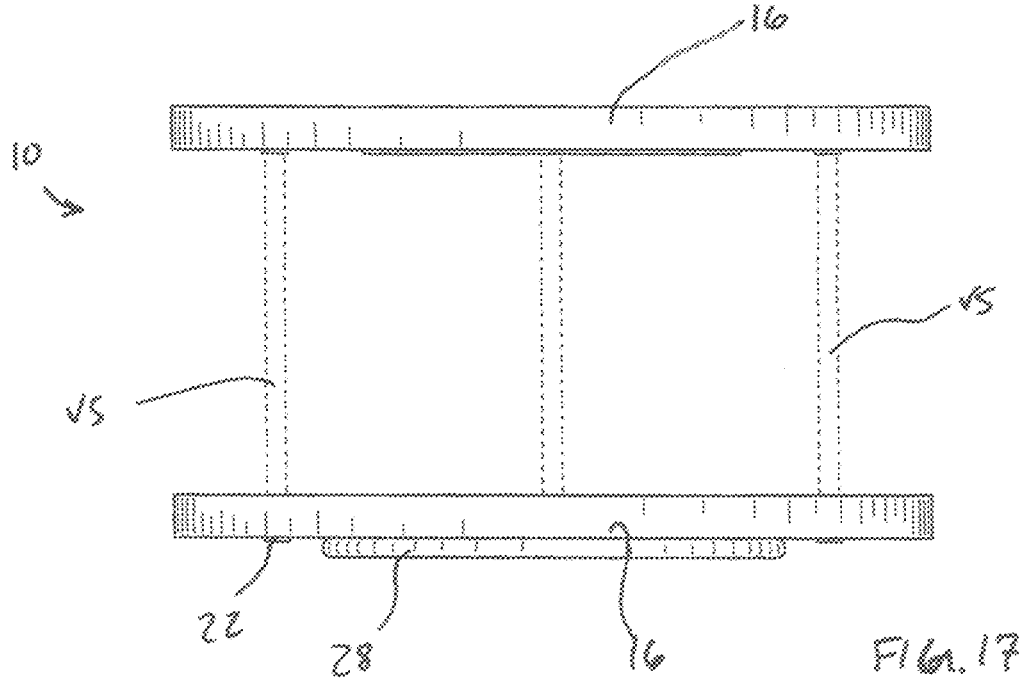
FIG. 17 illustrates a rear view of the exemplary embodiment of FIGS. 15-16.
Figure 18:
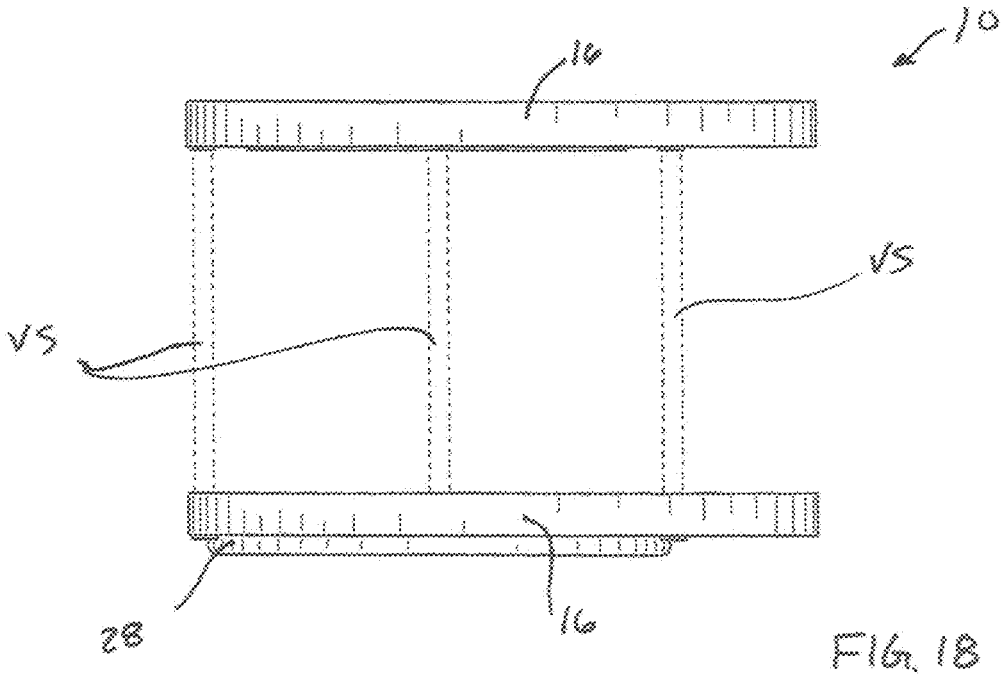
FIG. 18 illustrates a first side view of the exemplary embodiment of FIGS. 15-17.
Figure 19:
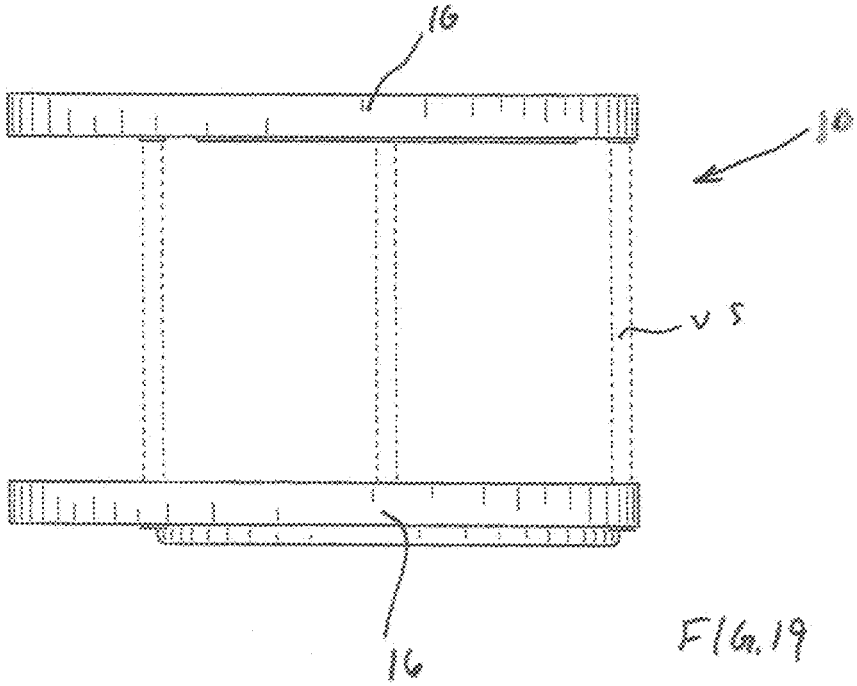
FIG. 19 illustrates a second side view of the exemplary embodiment of FIGS. 15-18.
Figure 20:
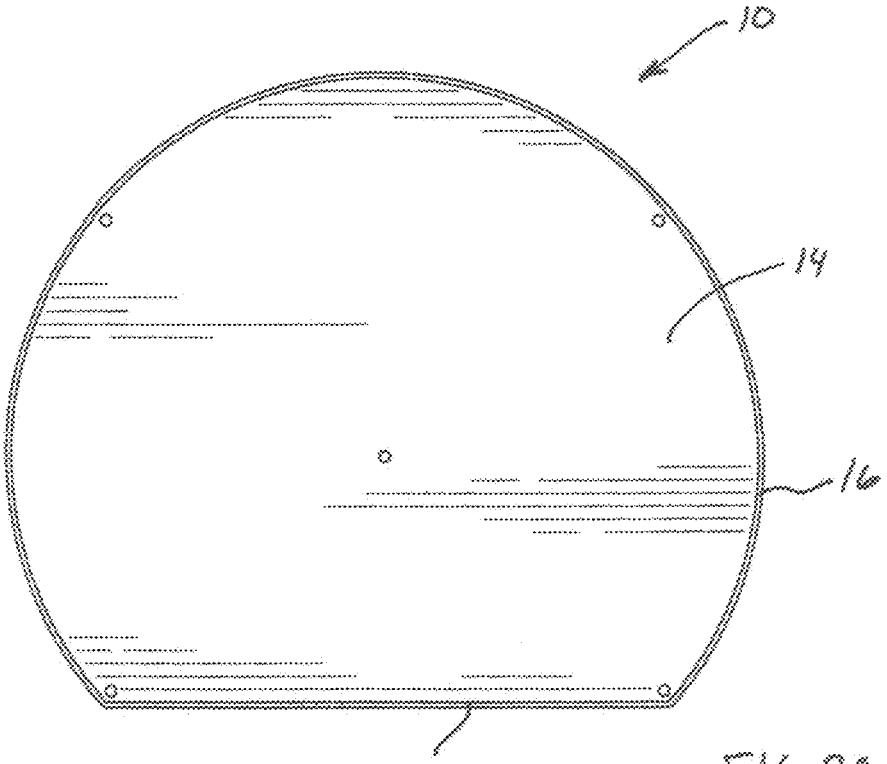
FIG. 20 illustrates a top view of the exemplary embodiment of FIGS. 15-19.
Figure 21:
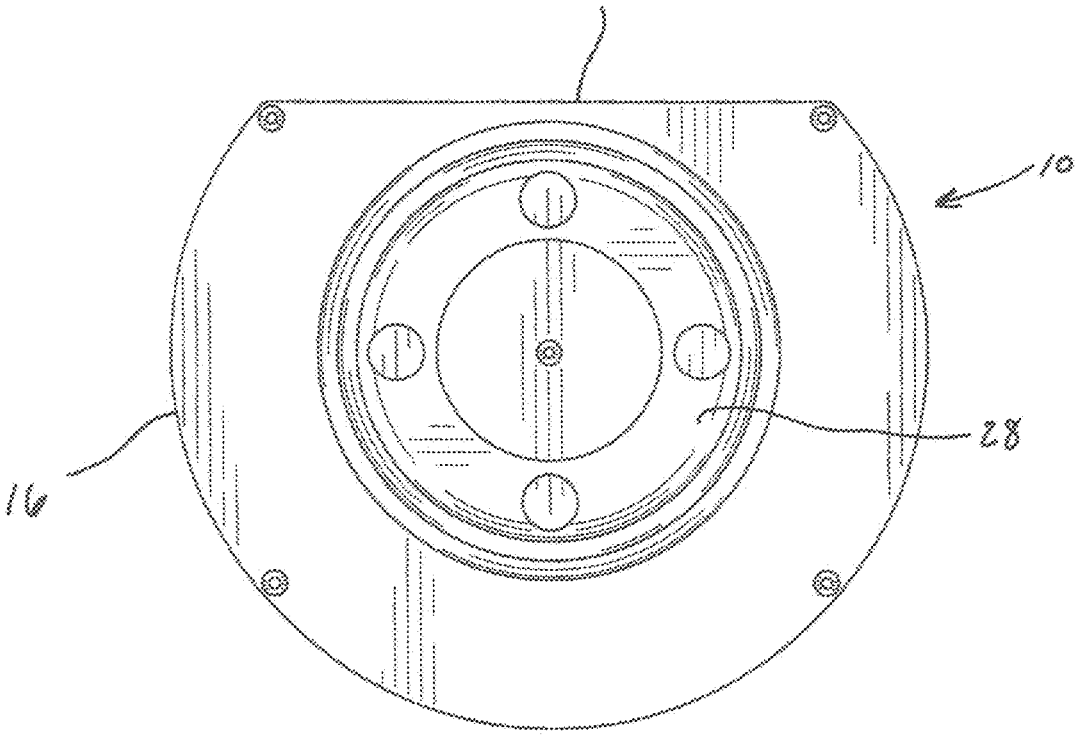
FIG. 21 illustrates a bottom view of the exemplary embodiment of FIGS. 15-20.

FIG. 16 illustrates a front view of the exemplary embodiment of FIG. 15. FIG. 17 illustrates a rear view of the exemplary embodiment of FIGS. 15-16. FIG. 18 illustrates a first side view of the exemplary embodiment of FIGS. 15-17. FIG. 19 illustrates a second side view of the exemplary embodiment of FIGS. 15-18. FIG. 20 illustrates a top view of the exemplary embodiment of FIGS. 15-19. FIG. 21 illustrates a bottom view of the exemplary embodiment of FIGS. 15-20.

Figure 22:
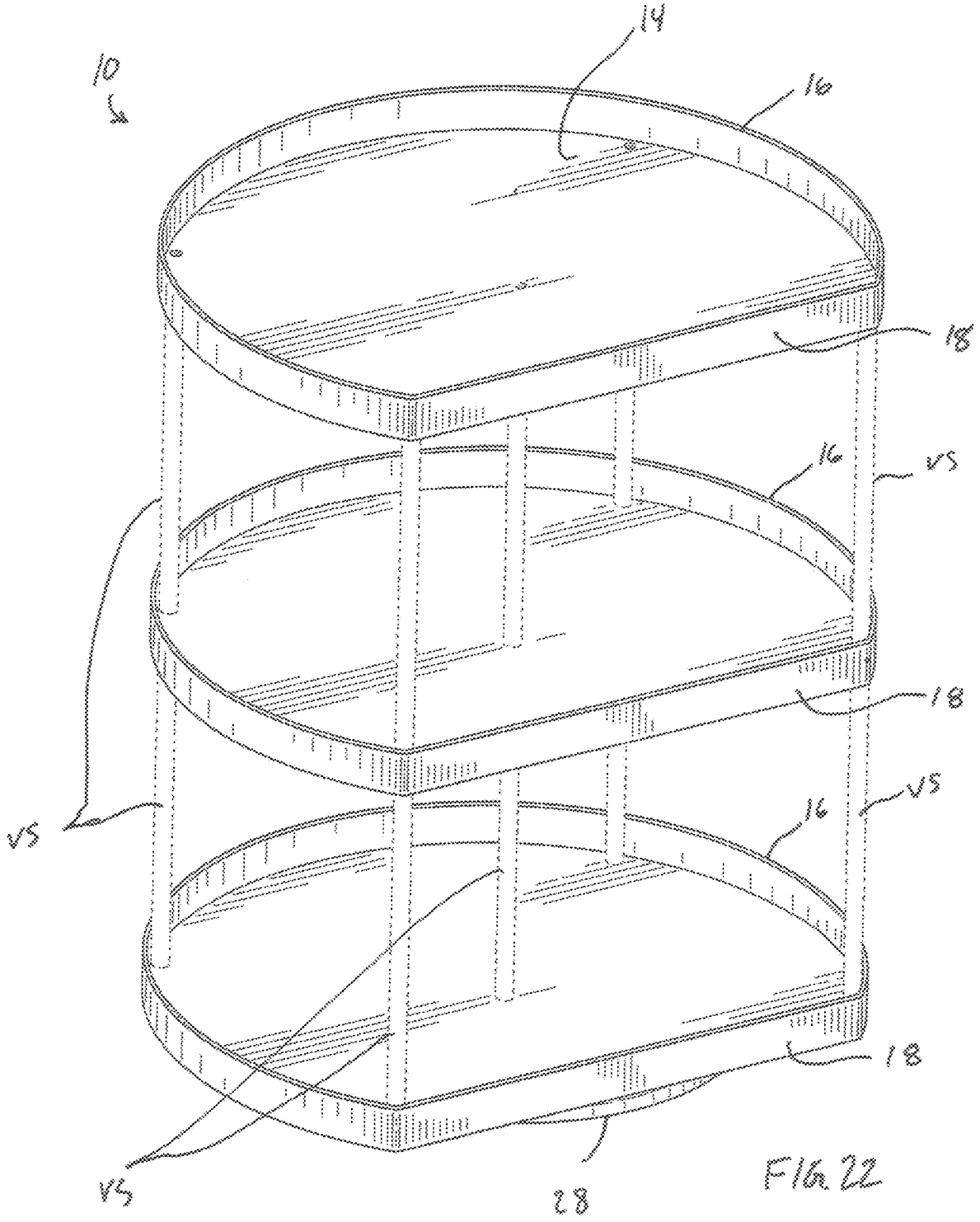
FIG. 22 illustrates a perspective view of an exemplary embodiment of the present invention showing an exemplary three shelf embodiment.

FIG. 22 illustrates a perspective view of an exemplary embodiment of the present invention showing an exemplary three shelf embodiment. Thus, a lower shelf and two upper shelves.

Figure 23:
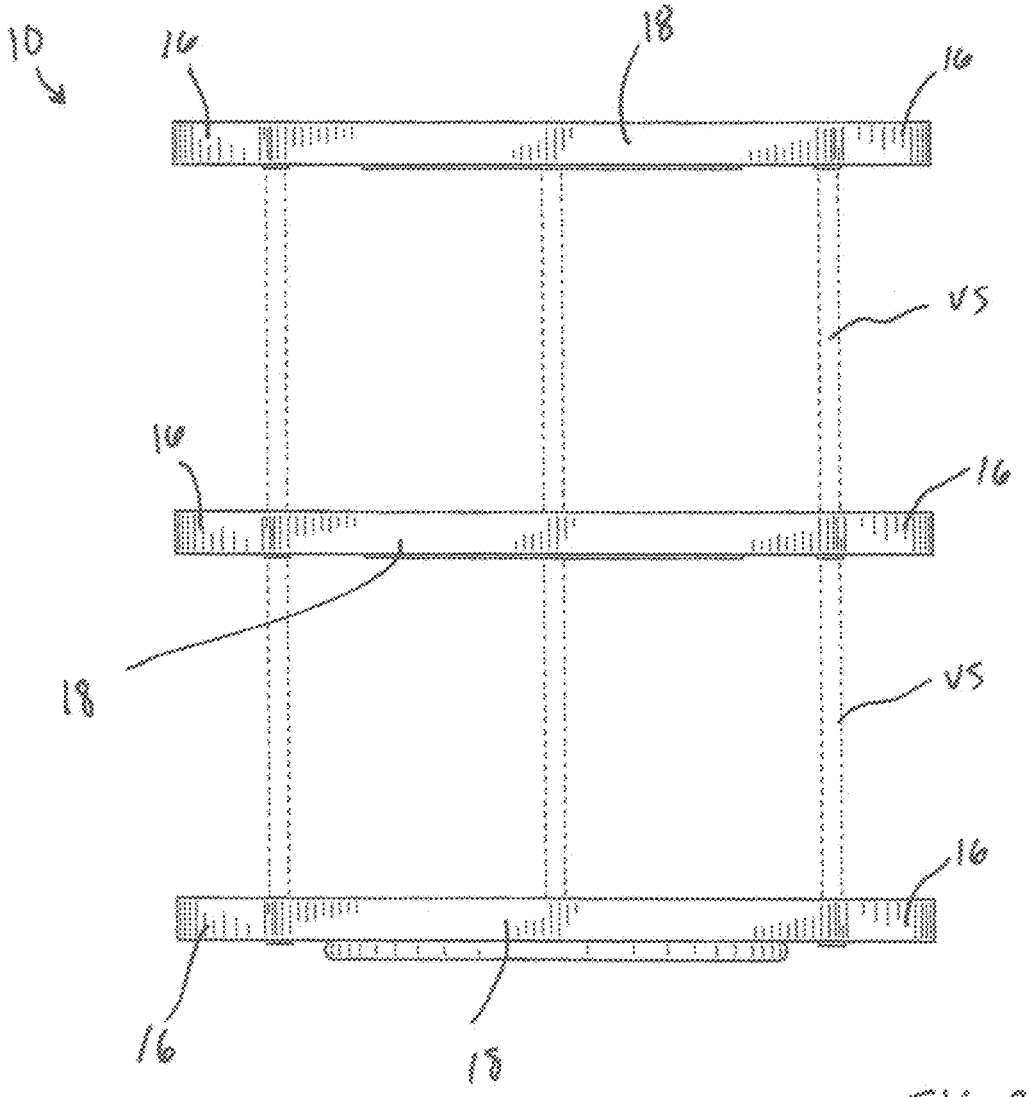
FIG. 23 illustrates a front view of the exemplary embodiment of FIG. 22.
Figure 24:
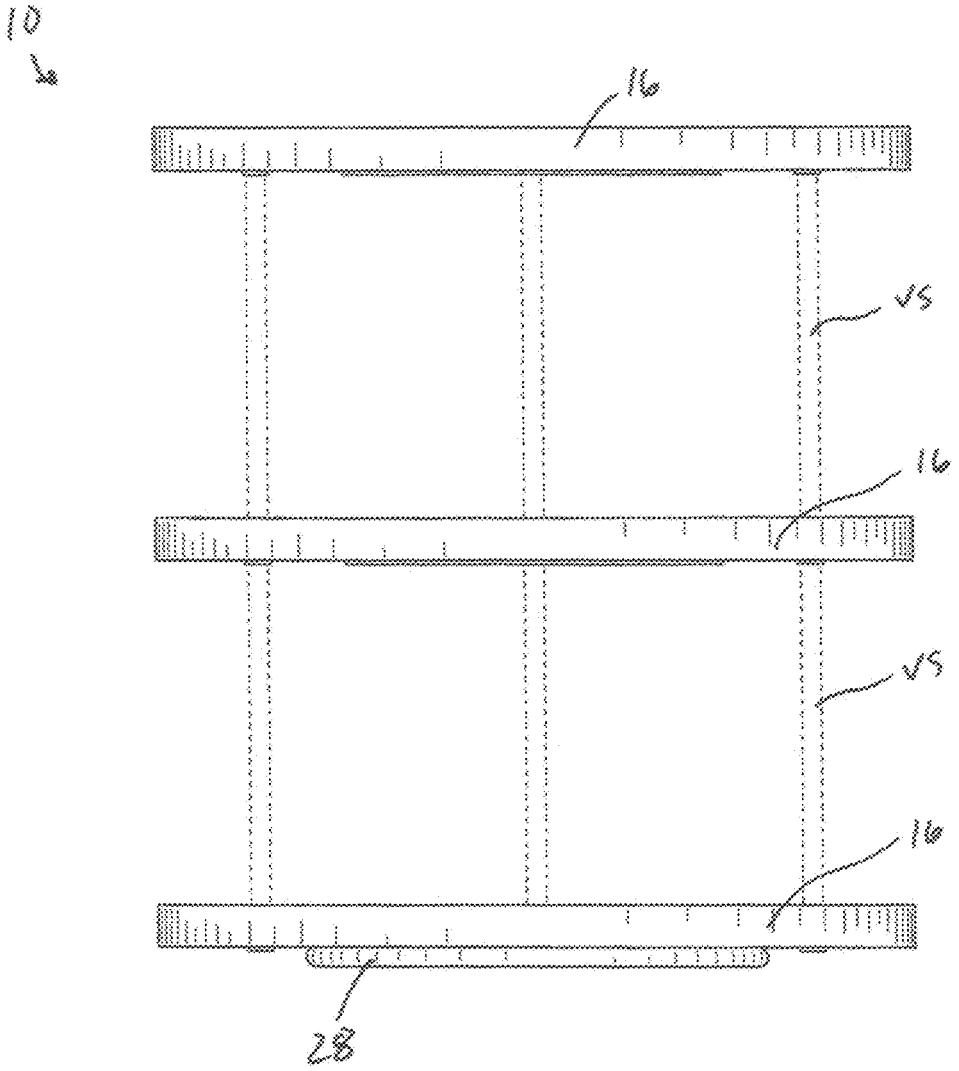
FIG. 24 illustrates a rear view of the exemplary embodiment of FIGS. 22-23.
Figure 25:
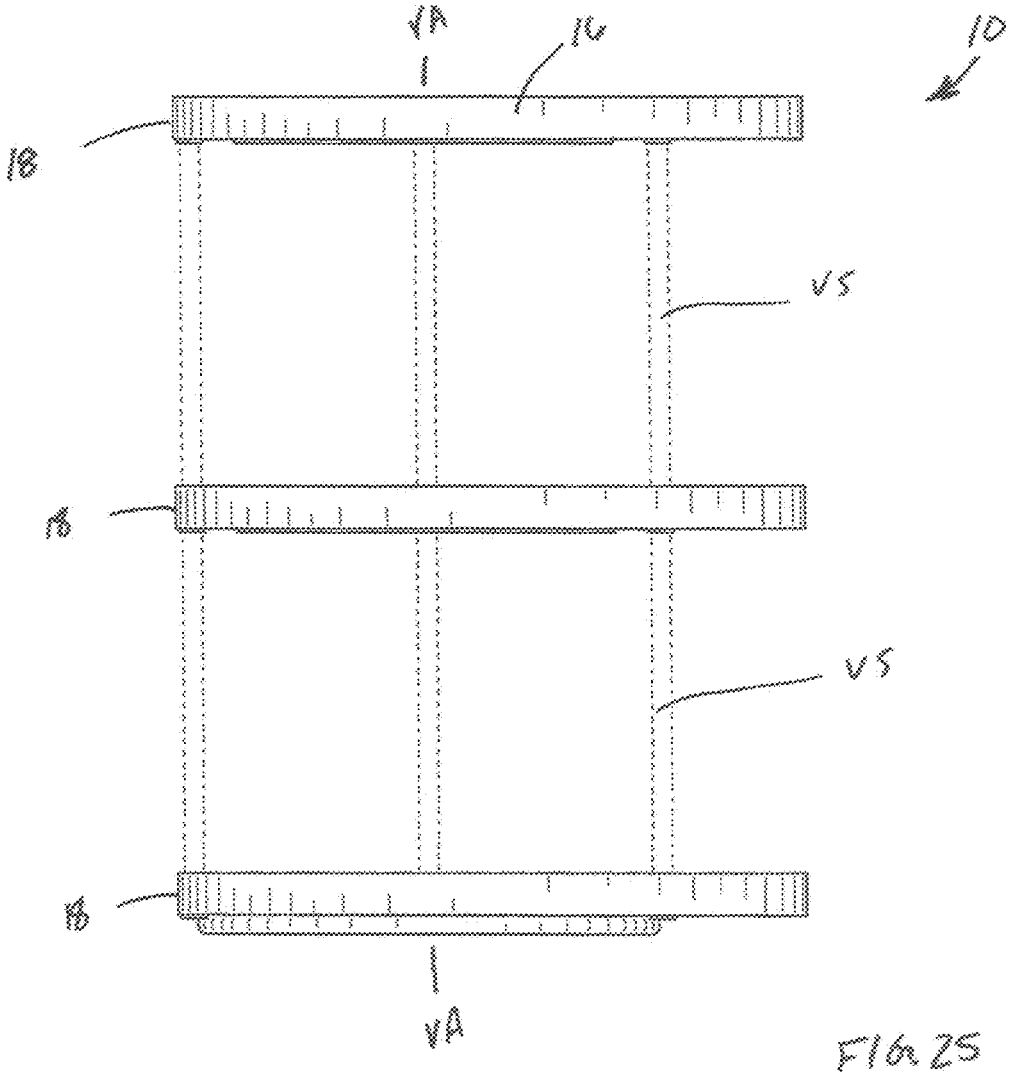
FIG. 25 illustrates a first side view of the exemplary embodiment of FIGS. 22-24.
Figure 26:
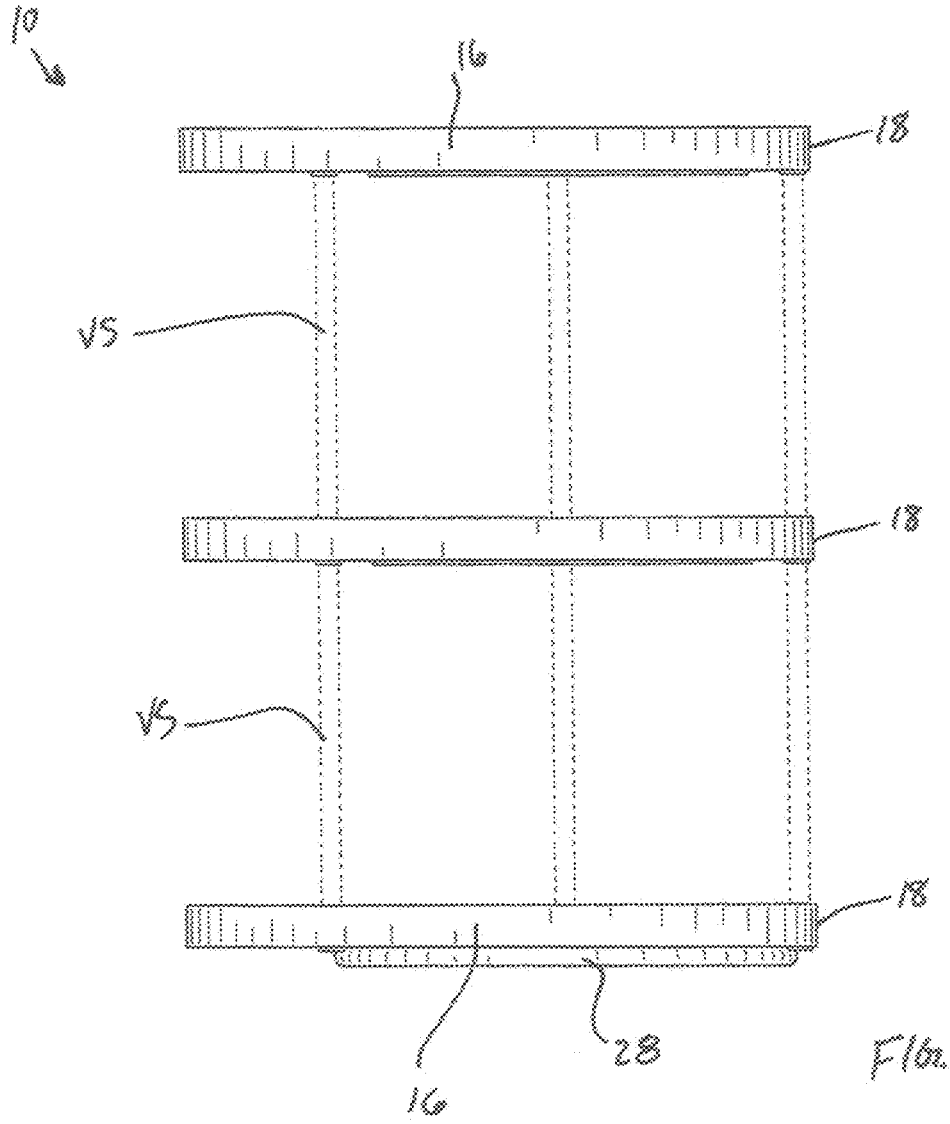
FIG. 26 illustrates a second side view of the exemplary embodiment of FIGS. 22-25.
Figure 27:
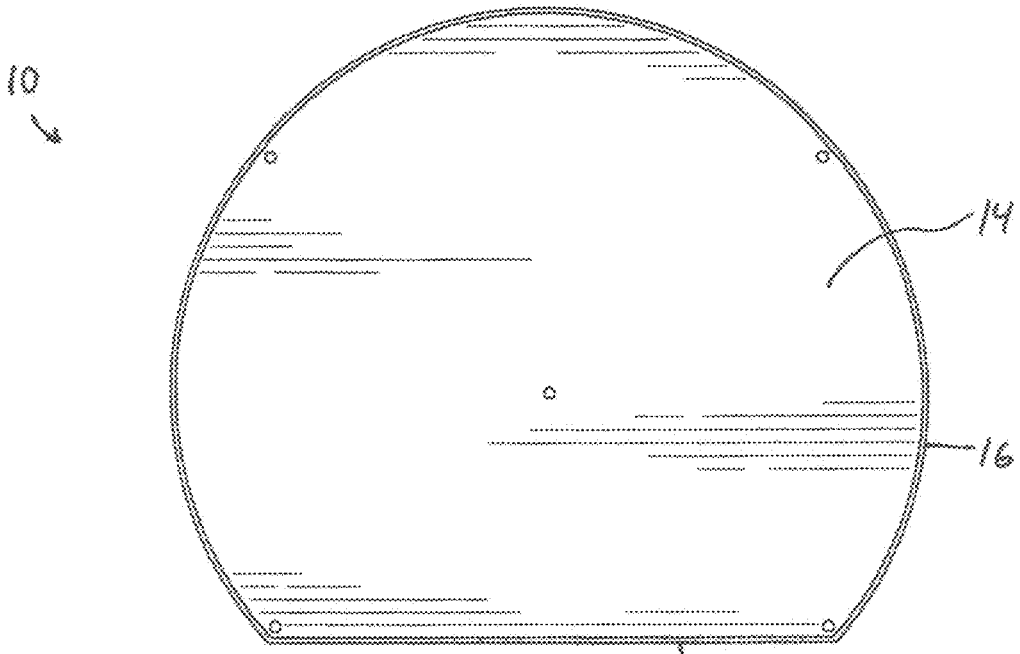
FIG. 27 illustrates a top view of the exemplary embodiment of FIGS. 22-26.
Figure 28:
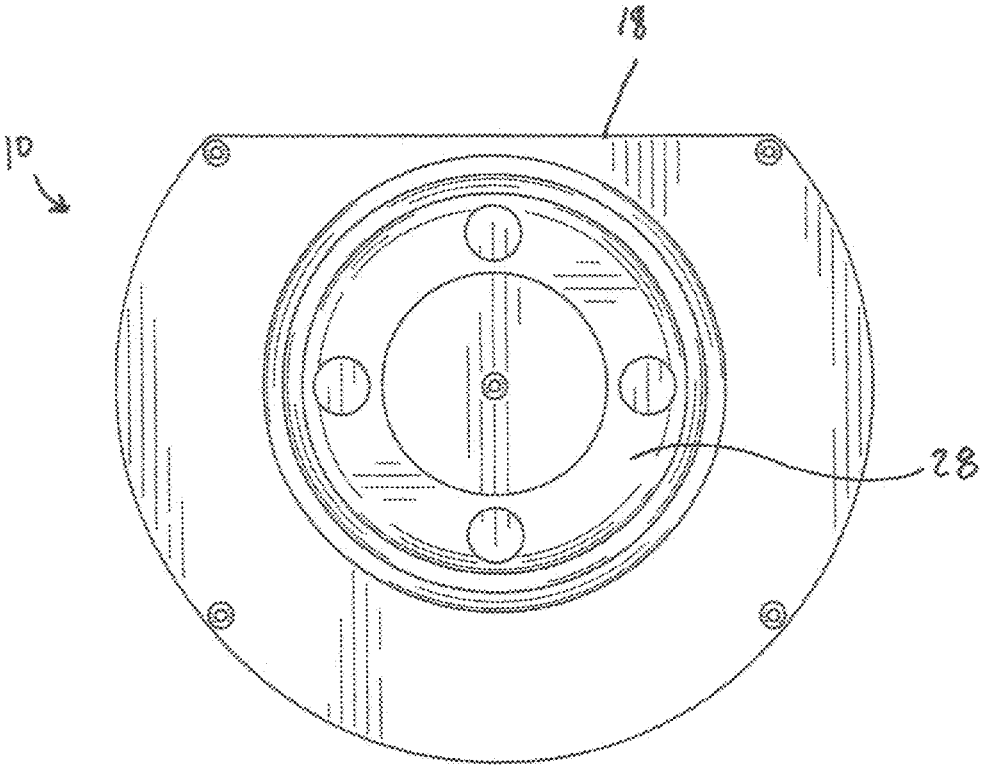
FIG. 28 illustrates a bottom view of the exemplary embodiment of FIGS. 22-27

FIG. 23 illustrates a front view of the exemplary embodiment of FIG. 22. FIG. 24 illustrates a rear view of the exemplary embodiment of FIGS. 22-23. FIG. 25 illustrates a first side view of the exemplary embodiment of FIGS. 22-24. FIG. 26 illustrates a second side view of the exemplary embodiment of FIGS. 22-25. FIG. 27 illustrates a top view of the exemplary embodiment of FIGS. 22-26. FIG. 28 illustrates a bottom view of the exemplary embodiment of FIGS. 22-27.

FIG. 29 illustrates a perspective view of an exemplary embodiment of the present invention showing an exemplary two shelf embodiment. This illustrates an exemplary device 10, upper shelf 40, lower shelf 42, second swiveling spinner/supplemental rotatable portion 44, curbed front wall portion 46, and cutout/hole/cavity/vertical opening 48.

In this embodiment, the entire device is rotatable via swiveling spinner/spinning mechanism/pivoting/rotating means 28 (see FIG. 30, etc.) and a portion of the device is independently spinnable, i.e., second swiveling spinner 44.

Either the entire device can be rotated via means 28, or second swiveling spinner 44 may be rotated/pivoted, or they may both (or neither) be pivoted/rotated. Cutout/opening/hole 48 allows for goods placed on second swiveling spinner 44 to extend upward without obstruction (whereas if the upper shelf 40 was exactly of the same shape as lower shelf/bottom shelf 42, the goods could only be as tall as the separation between the shelves. In the configuration illustrated, taller goods may be placed on/in this portion. Note that the shape of the upper shelf, i.e., upper shelf 40, is generally "C" shaped or kidney bean shaped to present such an ability. Various other embodiment illustrate other shapes for the upper (and lower) shelves. Some of these are round or D shaped. Note that there may also be more than two swiveling spinners.

Also illustrated for second swiveling spinner 44 is a raised lip 50 which, or course can be of any suitable configuration, or absent. The lip may help to keep goods in place.

Also note that the central axis of the two swiveling spinners/spinner mechanisms/swiveling spinners are parallel, but not coaxial in this embodiment. In some embodiments, the axes of the several swiveling spinners are coaxial.

Figure 30:
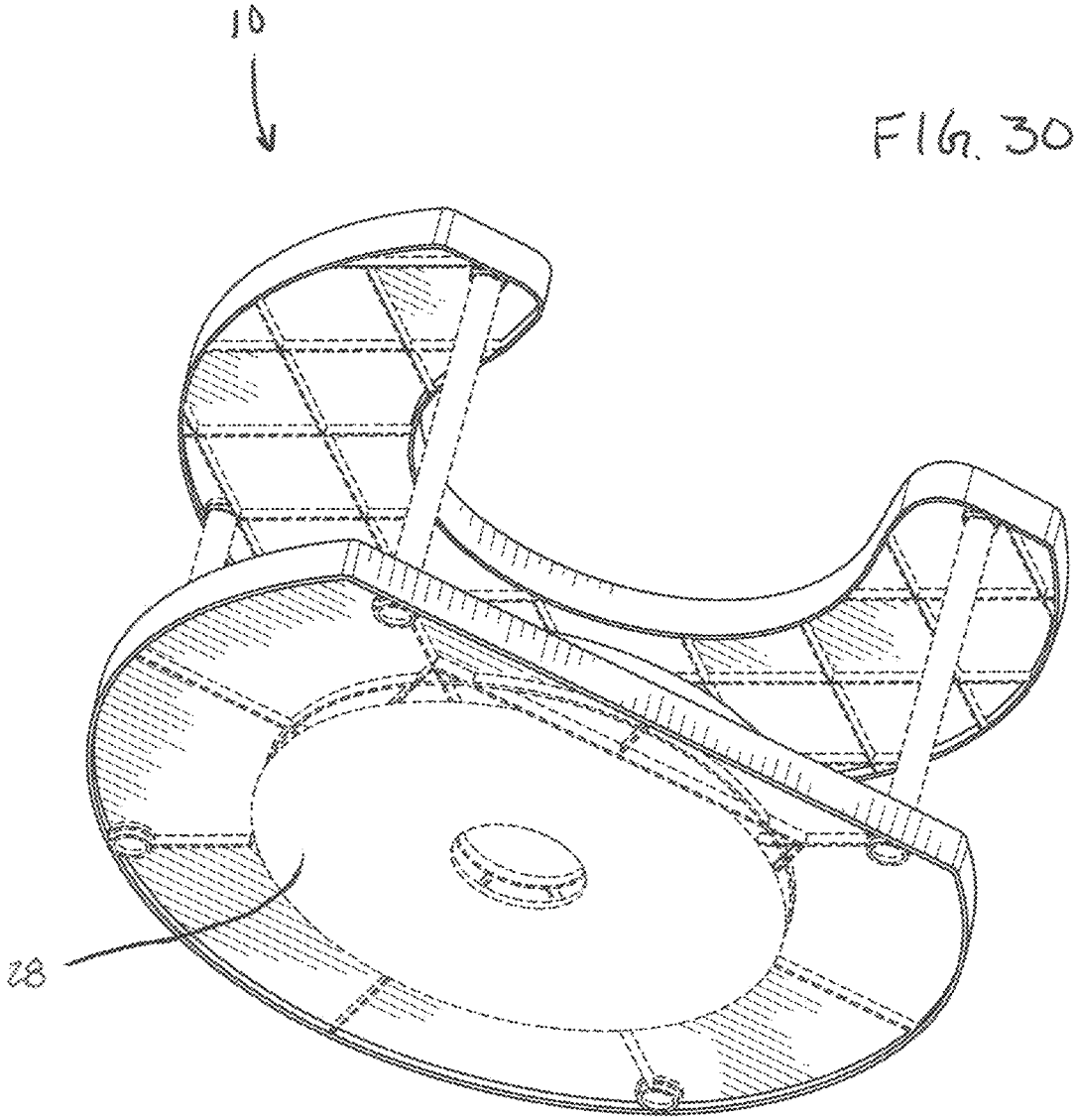
FIG. 30 illustrates a bottom perspective view of the exemplary embodiment of FIG. 29.
Figure 31:
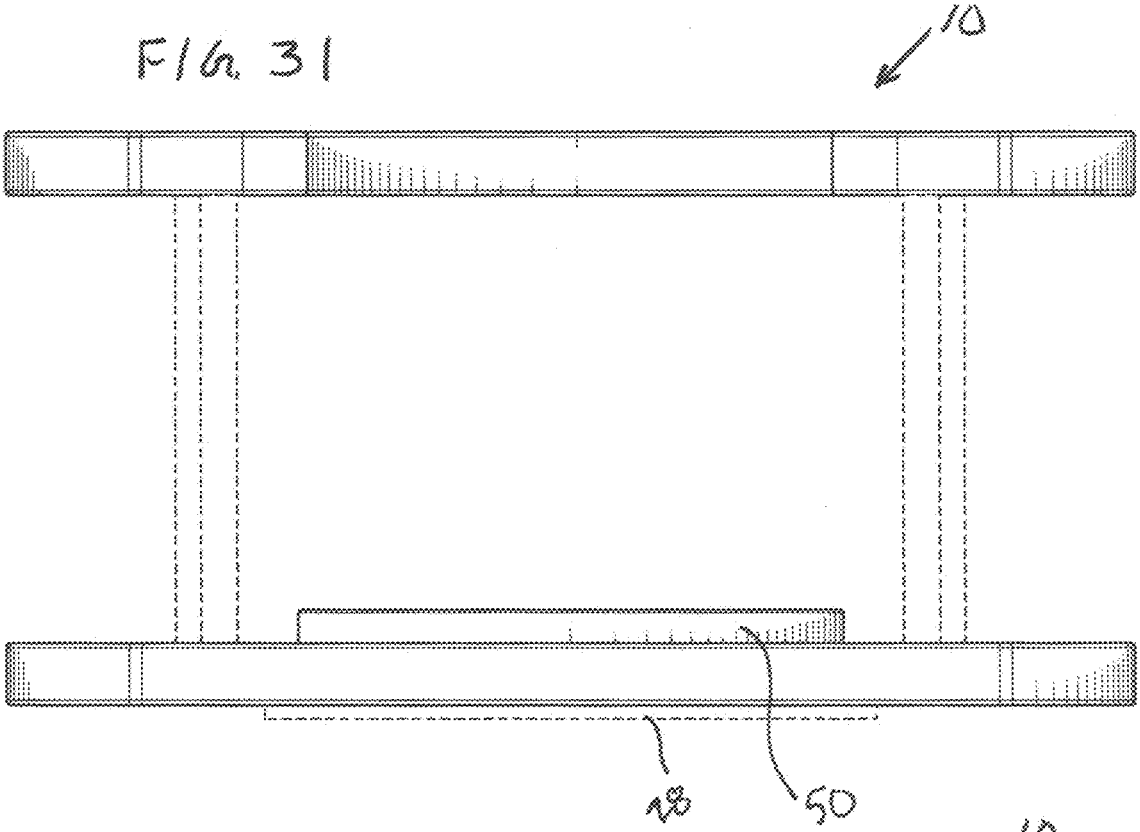
FIG. 31 illustrates a front view of the exemplary embodiment of FIG. 29-30.
Figure 32:
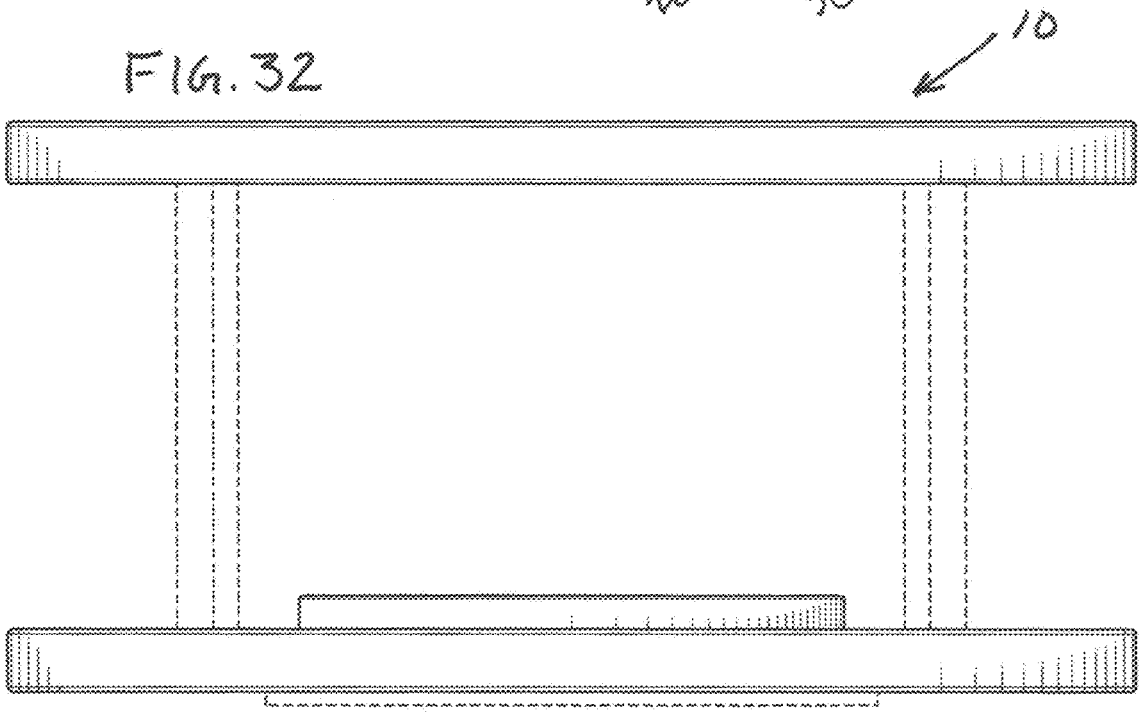
FIG. 32 illustrates a rear view of the exemplary embodiment of FIG. 29-31.
Figure 33:
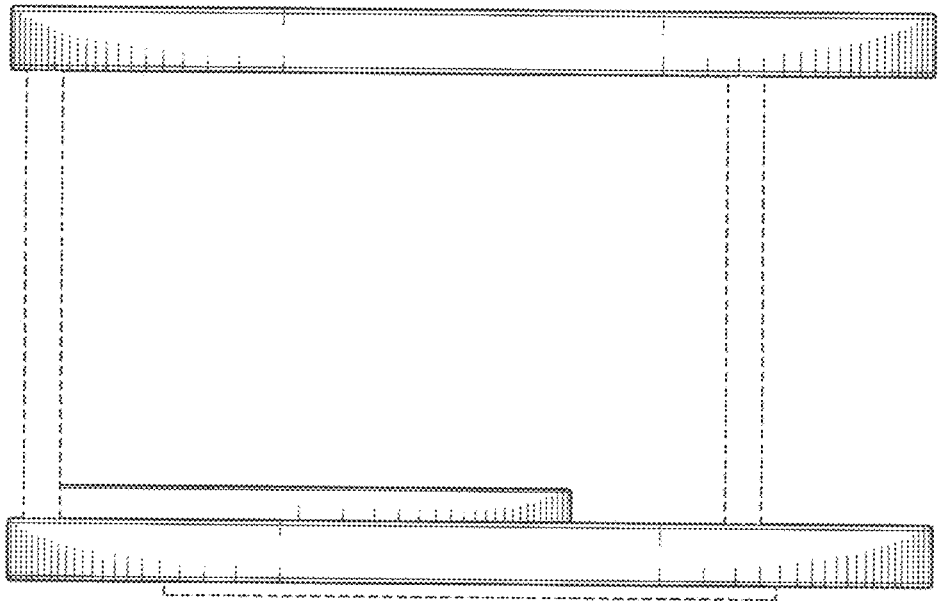
FIG. 33 illustrates a first side view of the exemplary embodiment of FIG. 29-32.
Figure 34:
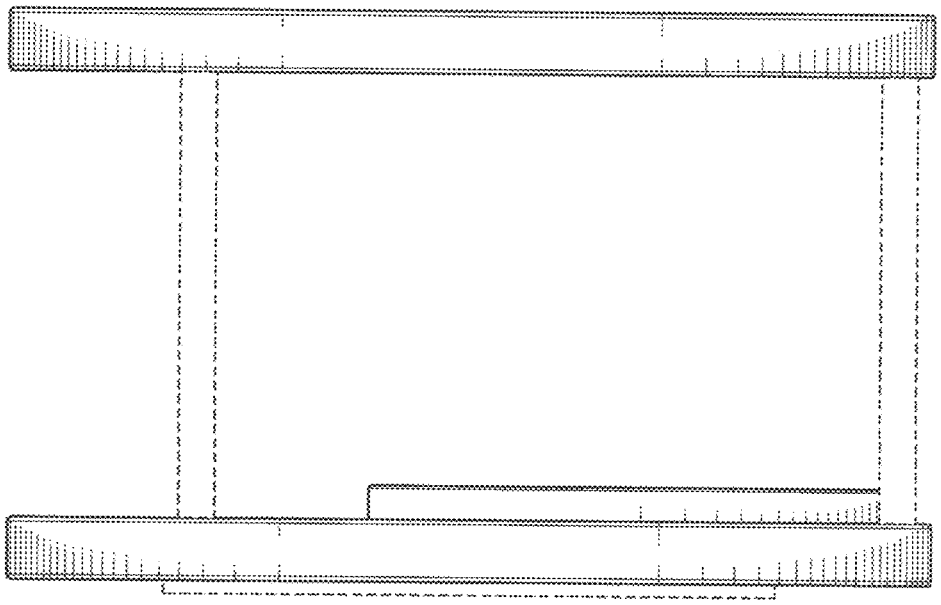
FIG. 34 illustrates a second side view of the exemplary embodiment of FIG. 29-33.
Figure 35:
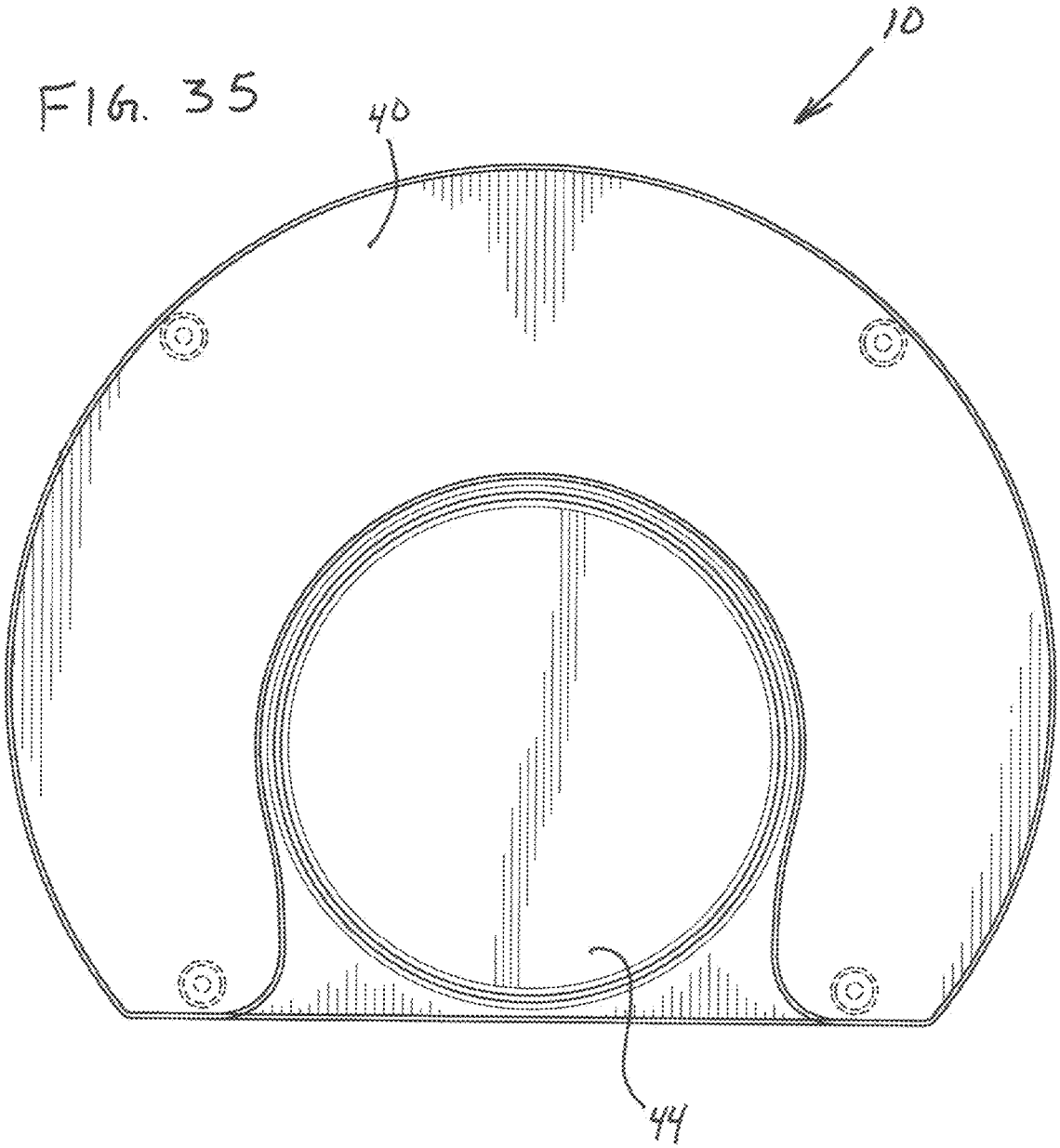
FIG. 35 illustrates a top view of the exemplary embodiment of FIG. 29-34.
Figure 36:
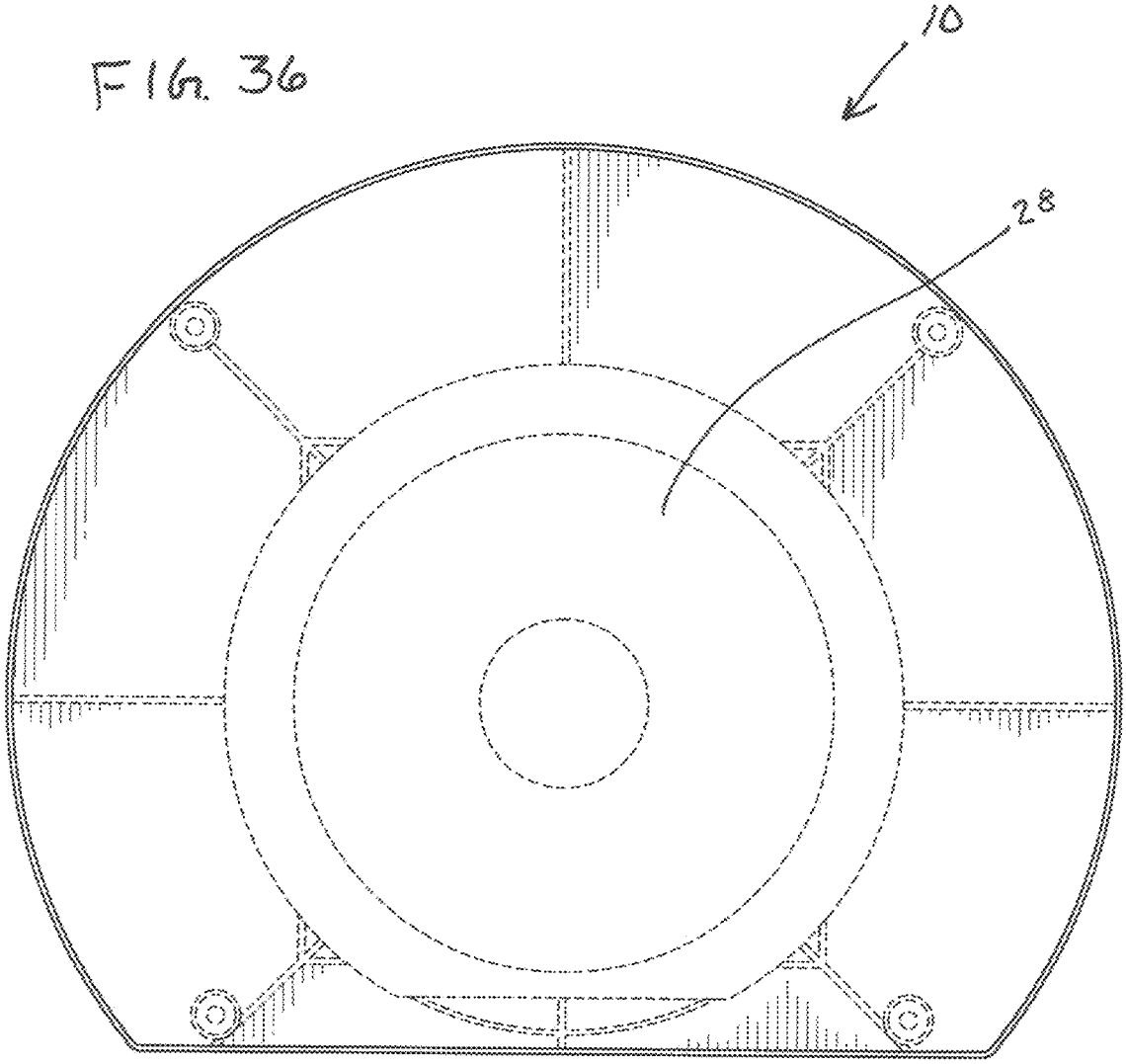
FIG. 36 illustrates a bottom view of the exemplary embodiment of FIG. 29-35.

FIG. 30 illustrates a bottom perspective view of the exemplary embodiment of FIG. 29. FIG. 31 illustrates a front view of the exemplary embodiment of FIG. 29-30. FIG. 32 illustrates a rear view of the exemplary embodiment of FIG. 29-31. FIG. 33 illustrates a first side view of the exemplary embodiment of FIG. 29-32. FIG. 34 illustrates a second side view of the exemplary embodiment of FIG. 29-33. FIG. 35 illustrates a top view of the exemplary embodiment of FIG. 29-34. FIG. 36 illustrates a bottom view of the exemplary embodiment of FIG. 29-35.

Figure 37:
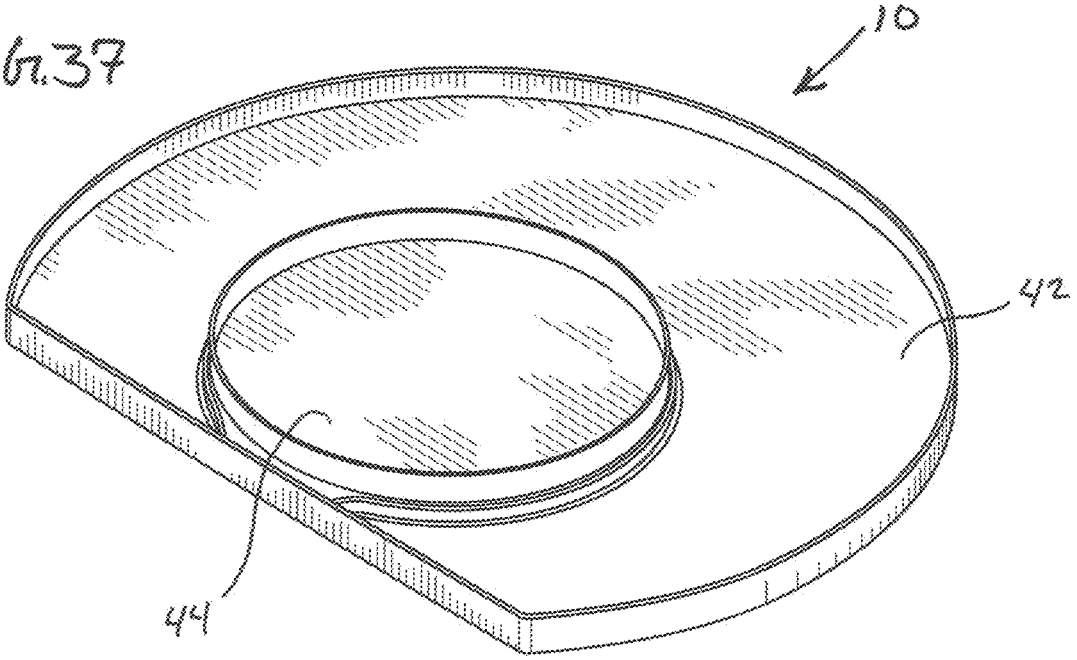
FIG. 37 illustrates a perspective view of an exemplary embodiment of the present invention showing an exemplary two shelf embodiment.

FIG. 37 illustrates a perspective view of an exemplary embodiment of the present invention showing an exemplary one shelf embodiment. In this embodiment, there is a first swiveling spinner 28 (see FIG. 38) as well as a second swiveling spinner 44.

Figure 38:
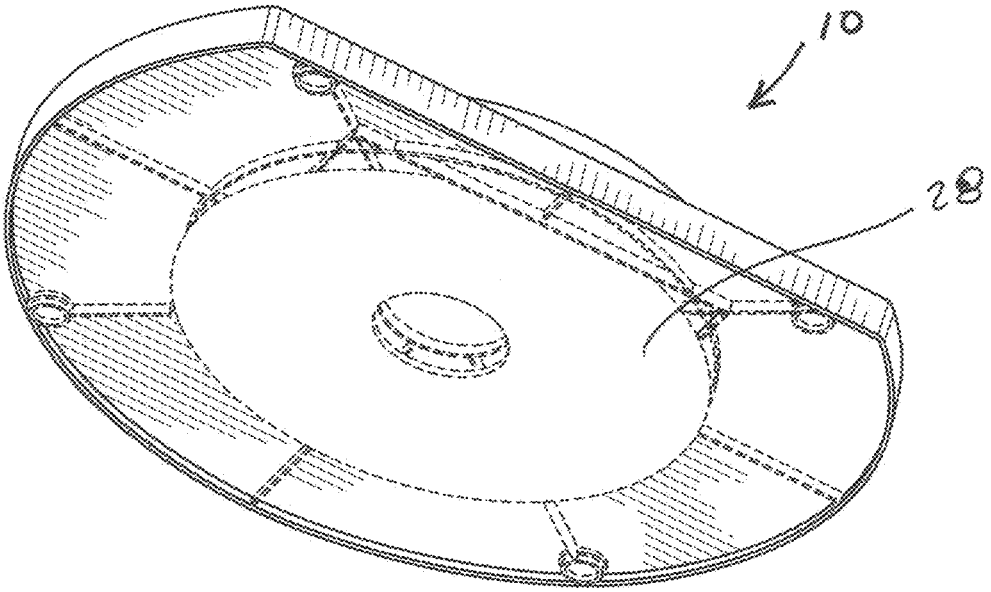
FIG. 38 illustrates a bottom perspective view of the exemplary embodiment of FIG. 37.
Figure 39:
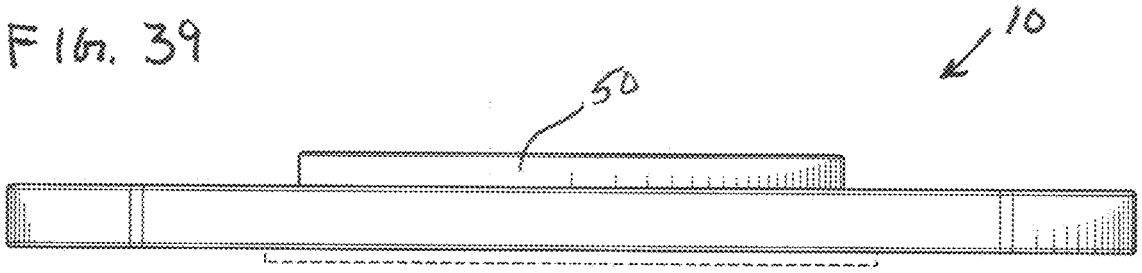
FIG. 39 illustrates a front view of the exemplary embodiment of FIG. 37-38.
Figure 40:
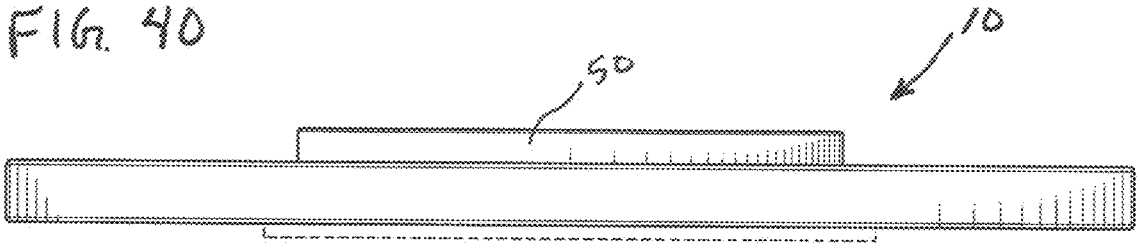
FIG. 40 illustrates a rear view of the exemplary embodiment of FIG. 37-39.
Figure 41:
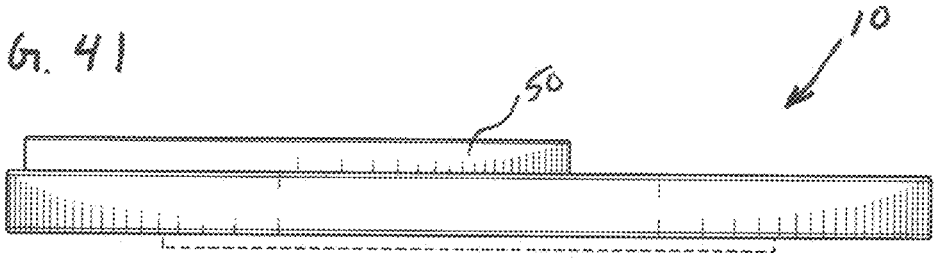
FIG. 41 illustrates a first side view of the exemplary embodiment of FIG. 37-40.
Figure 42:
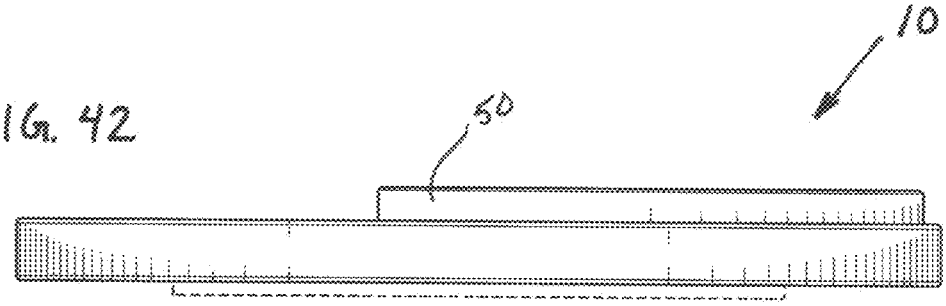
FIG. 42 illustrates a second side view of the exemplary embodiment of FIG. 37-41.
Figure 43:
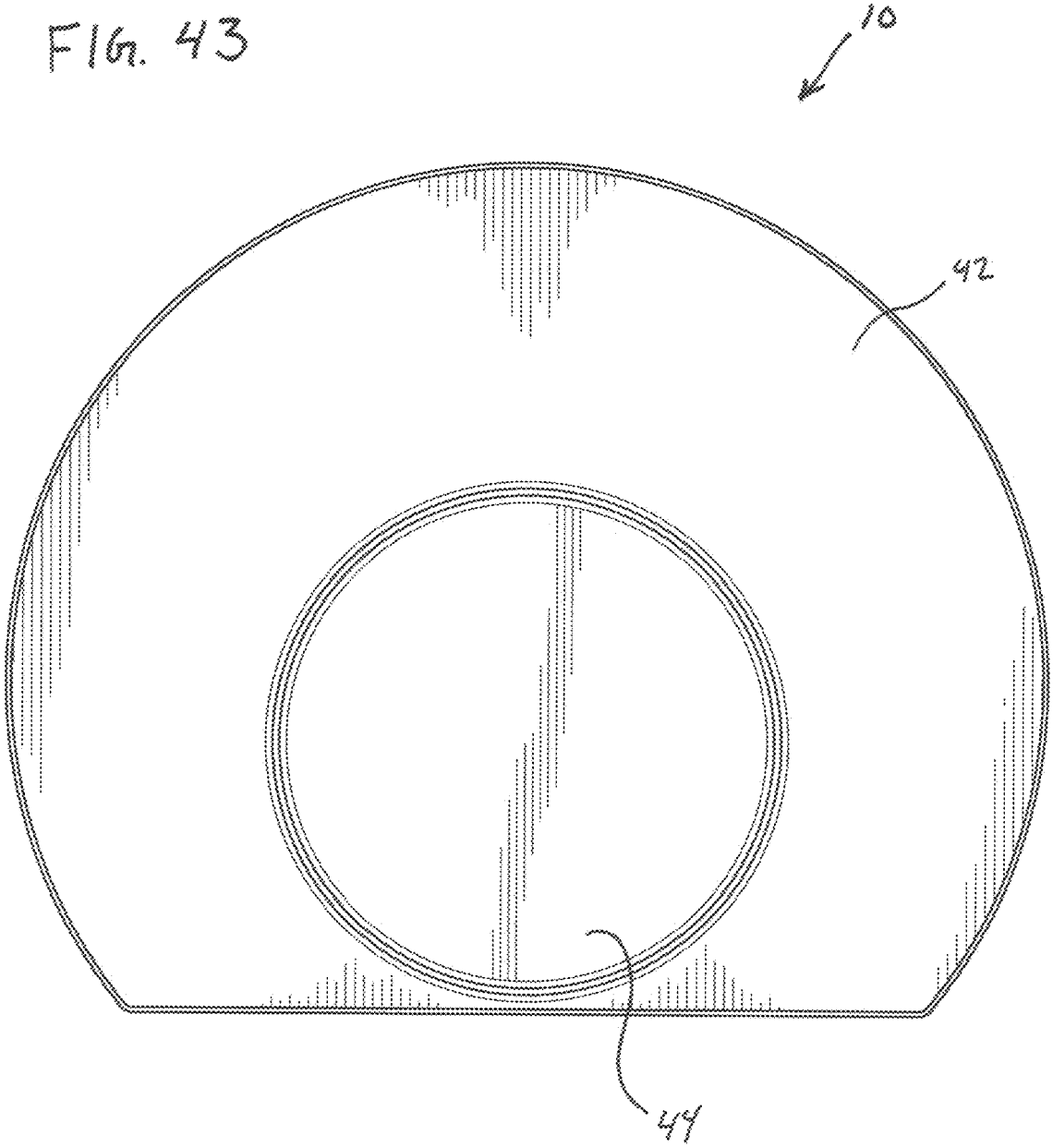
FIG. 43 illustrates a top view of the exemplary embodiment of FIG. 37-42.
Figure 44:
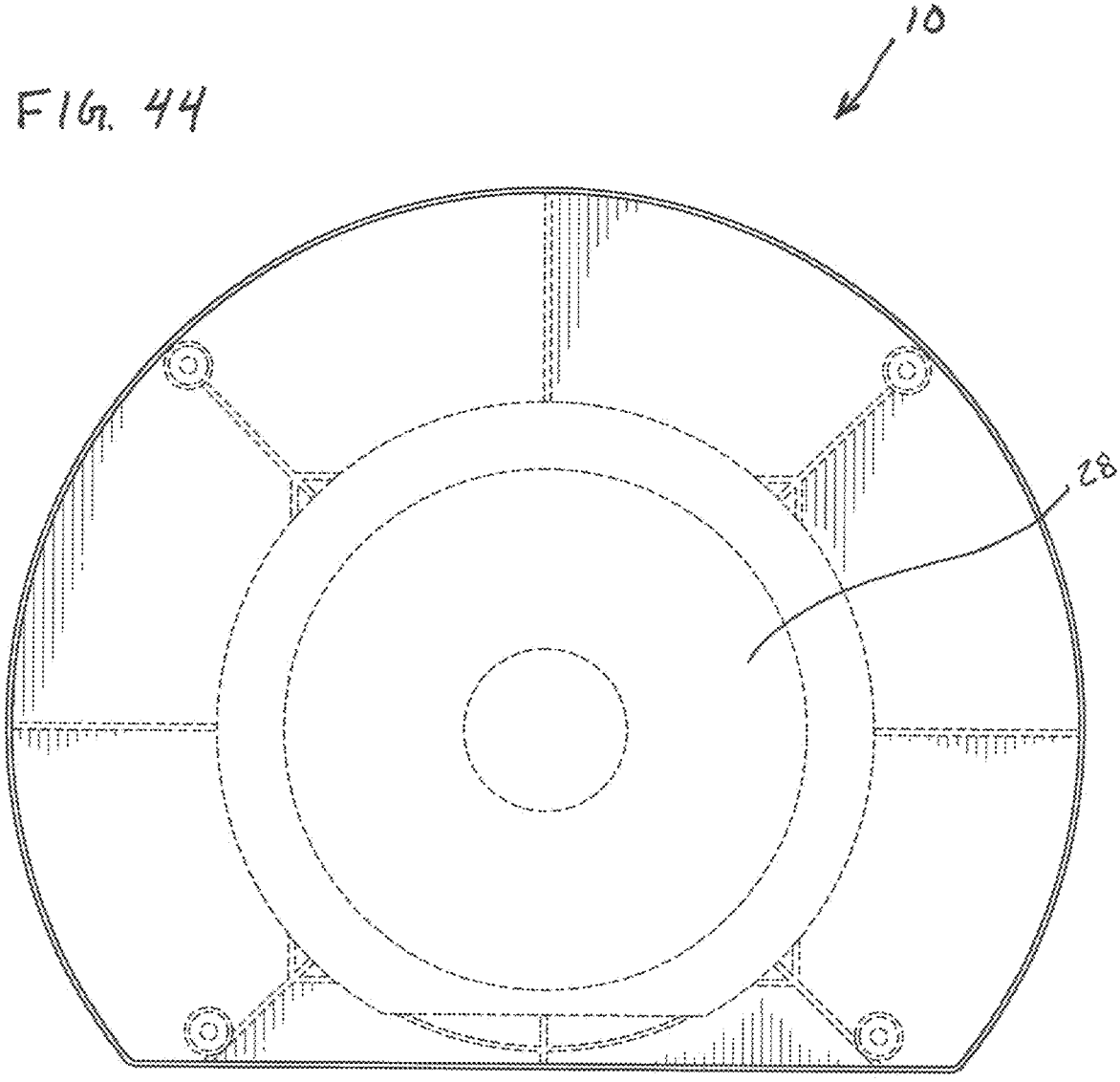
FIG. 44 illustrates a bottom view of the exemplary embodiment of FIG. 37-43.

FIG. 38 illustrates a bottom perspective view of the exemplary embodiment of FIG. 37. FIG. 39 illustrates a front view of the exemplary embodiment of FIG. 37-38. FIG. 40 illustrates a rear view of the exemplary embodiment of FIG. 37-39. FIG. 41 illustrates a first side view of the exemplary embodiment of FIG. 37-40. FIG. 42 illustrates a second side view of the exemplary embodiment of FIG. 37-41. FIG. 43 illustrates a top view of the exemplary embodiment of FIG. 37-42. FIG. 44 illustrates a bottom view of the exemplary embodiment of FIG. 37-43.

Figure 45:
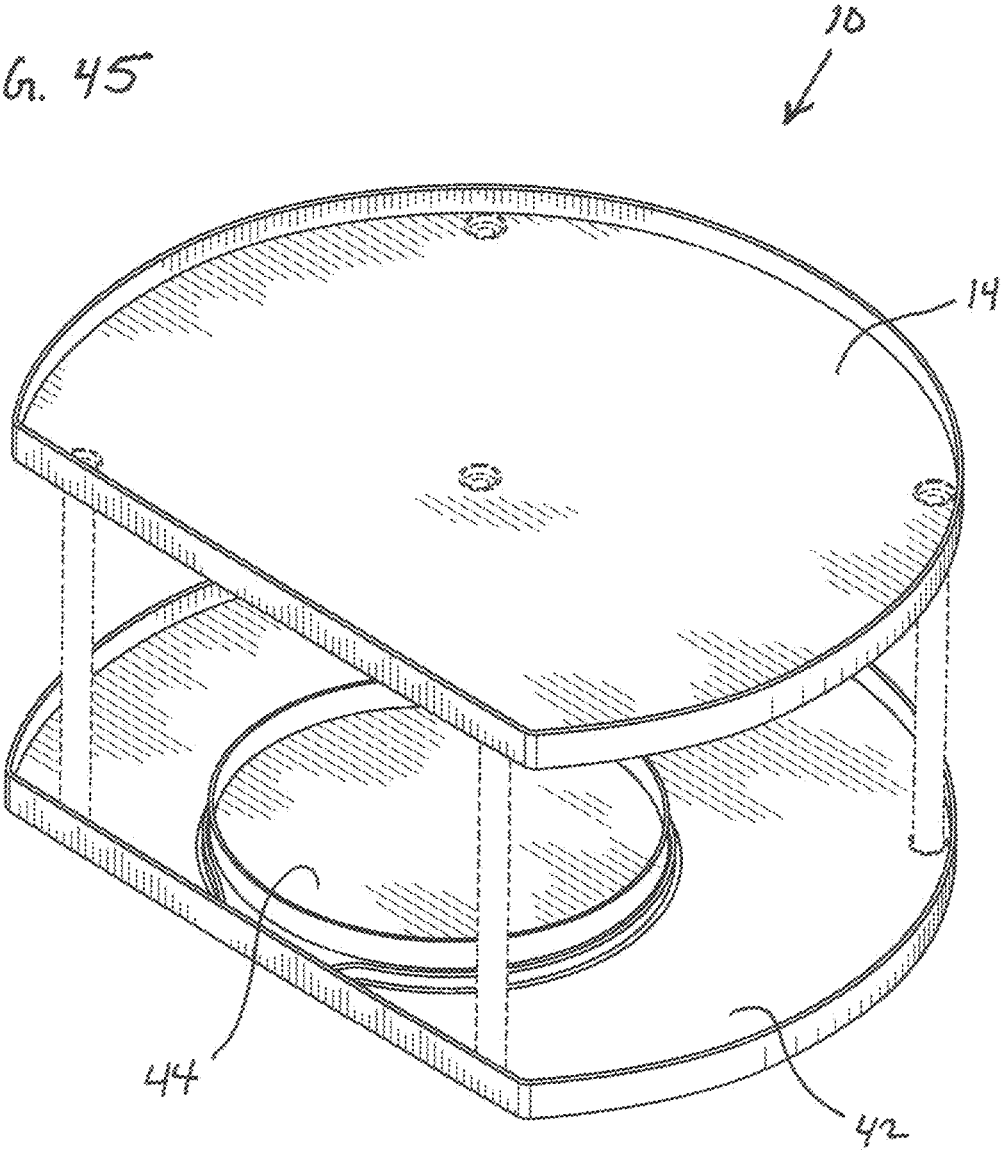
FIG. 45 illustrates a perspective view of an exemplary embodiment of the present invention showing an exemplary two shelf embodiment.

FIG. 45 illustrates a perspective view of an exemplary embodiment of the present invention showing an exemplary two shelf embodiment along with a second swiveling spinner 44.

Figure 46:
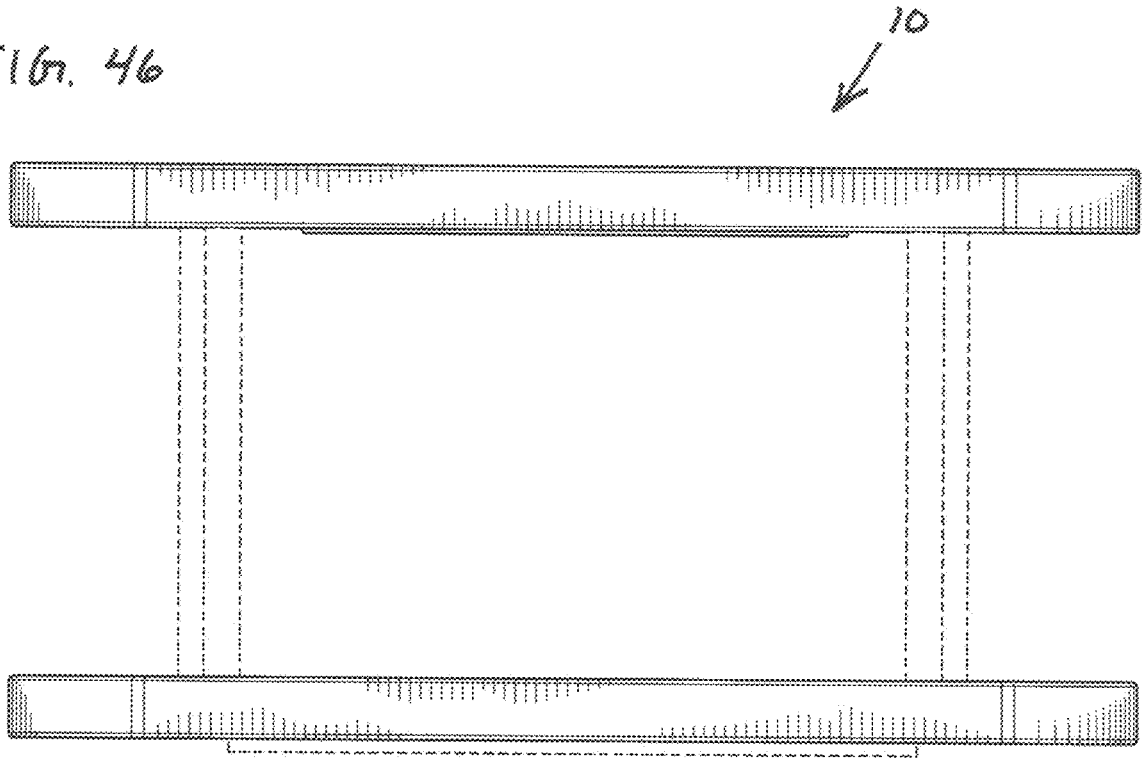
FIG. 46 illustrates a front view of the exemplary embodiment of FIG. 45.
Figure 47:
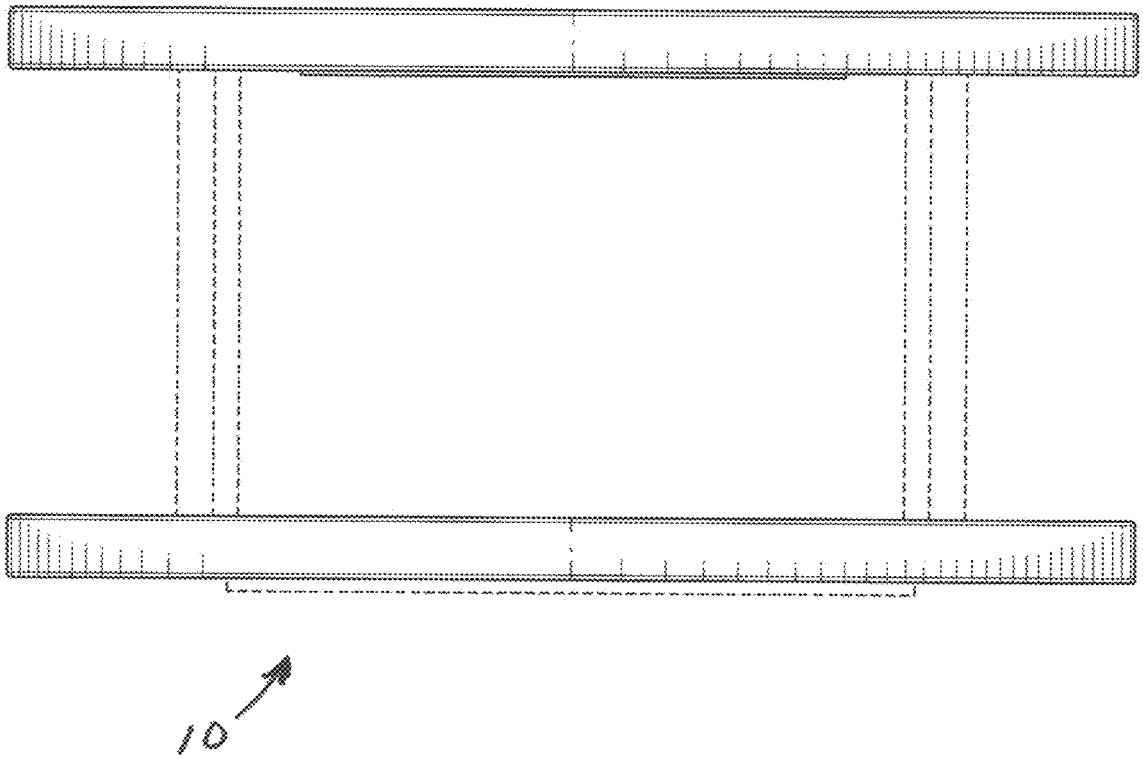
FIG. 47 illustrates a rear view of the exemplary embodiment of FIGS. 45-46.
Figure 48:
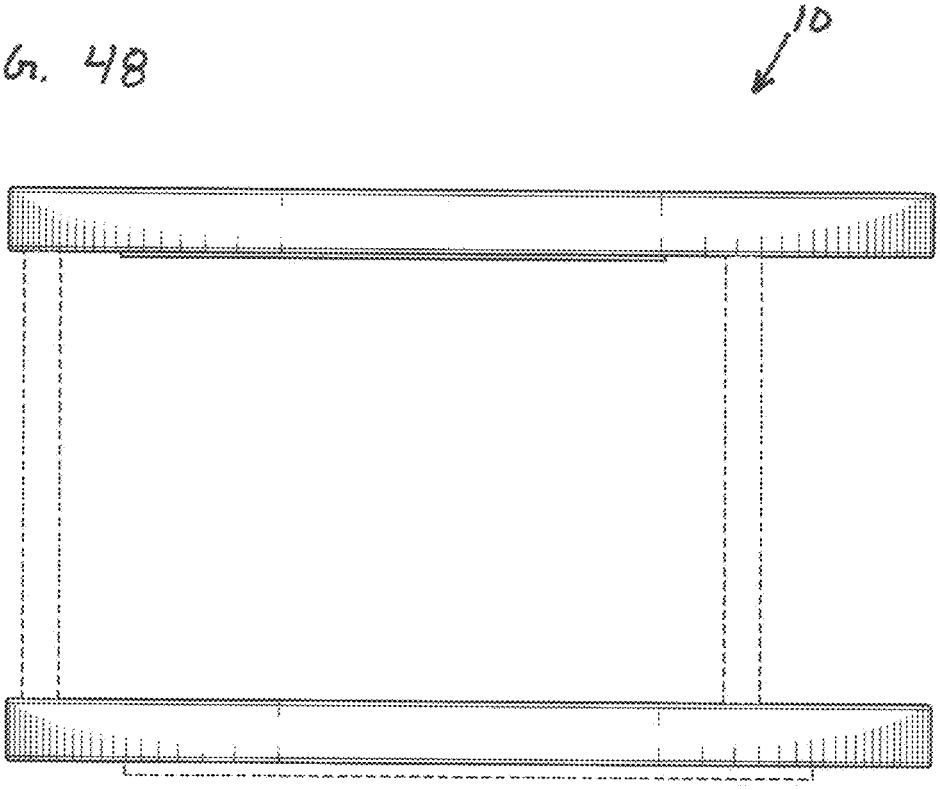
FIG. 48 illustrates a first side view of the exemplary embodiment of FIG. 45-47.
Figure 49:
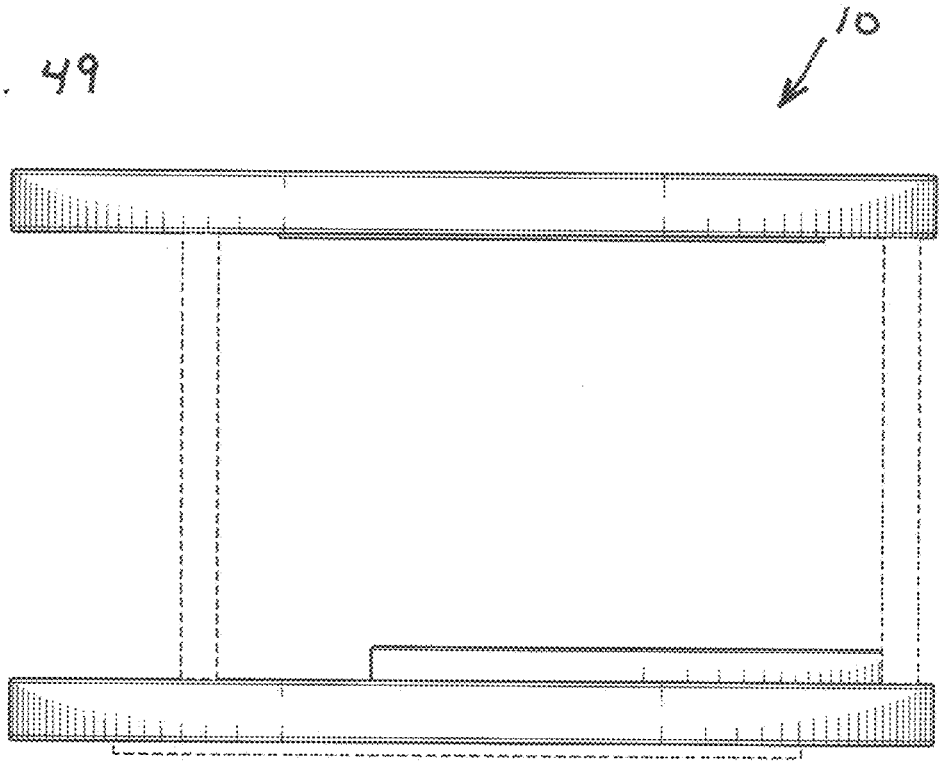
FIG. 49 illustrates a second side view of the exemplary embodiment of FIG. 45-48.
Figure 50:
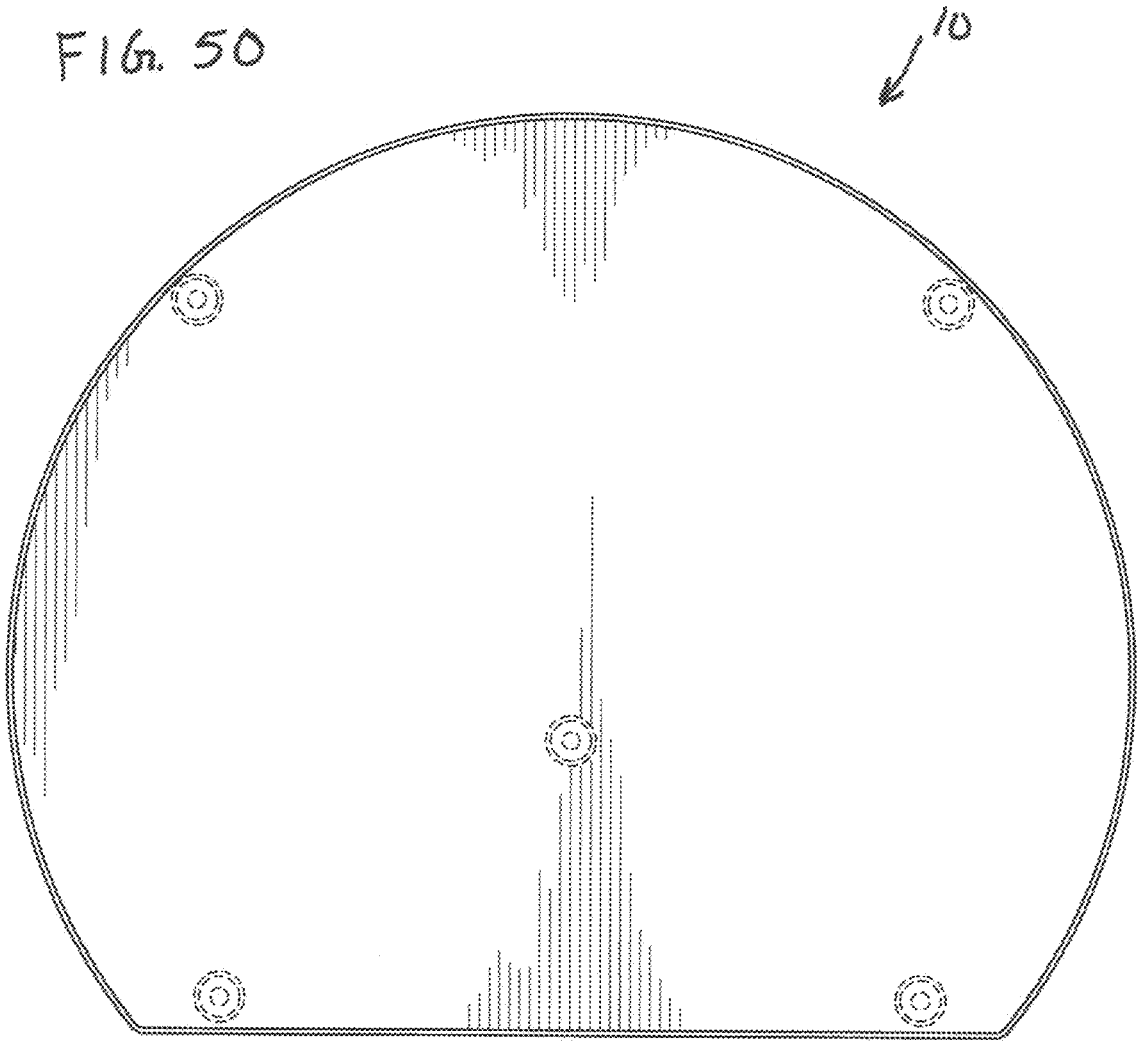
FIG. 50 illustrates a top view of the exemplary embodiment of FIG. 45-49.
Figure 51:
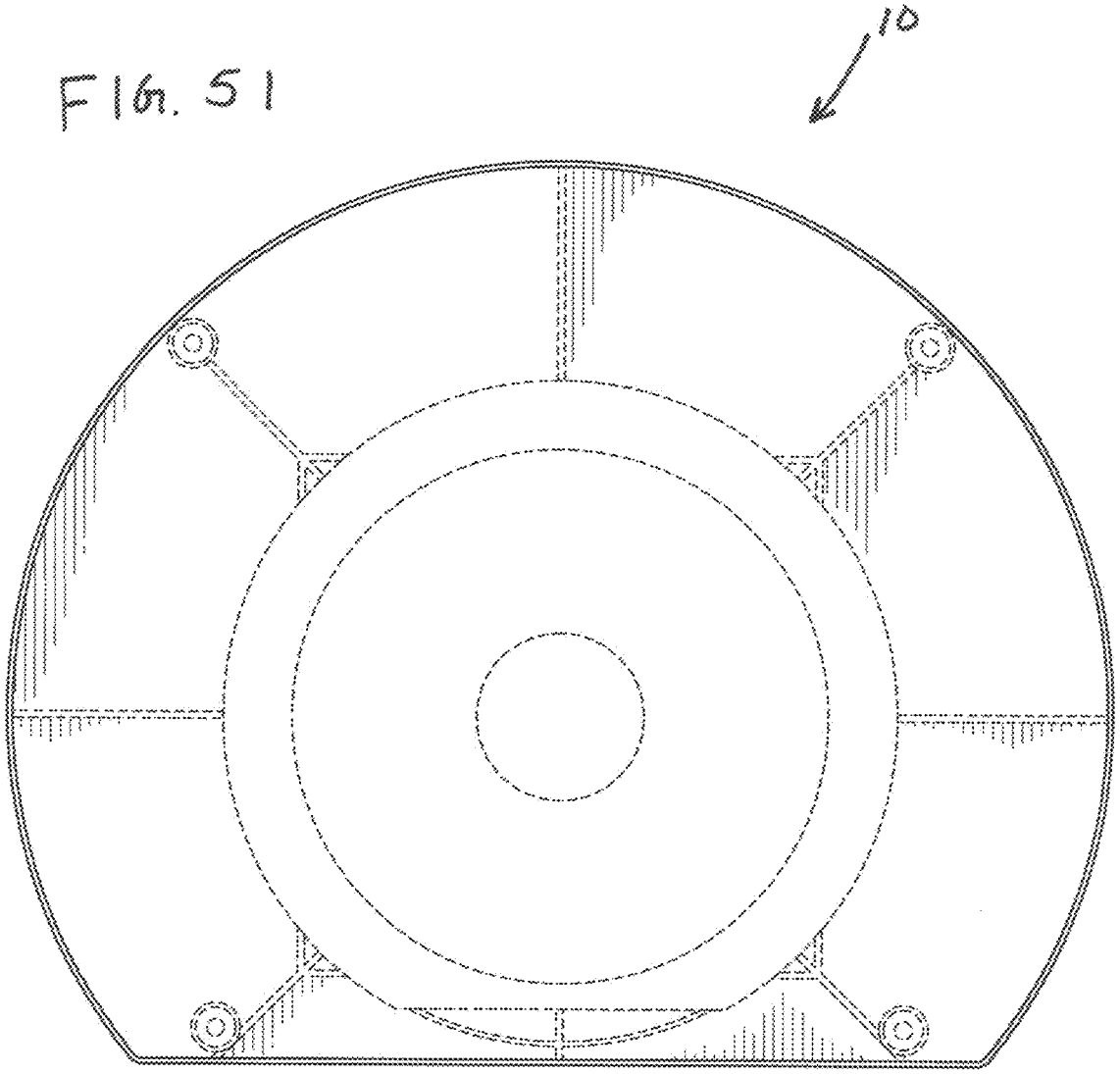
FIG. 51 illustrates a bottom view of the exemplary embodiment of FIG. 45-50.

FIG. 46 illustrates a front view of the exemplary embodiment of FIG. 45. FIG. 47 illustrates a rear view of the exemplary embodiment of FIGS. 45-46. FIG. 48 illustrates a first side view of the exemplary embodiment of FIG. 45-47. FIG. 49 illustrates a second side view of the exemplary embodiment of FIG. 45-48. FIG. 50 illustrates a top view of the exemplary embodiment of FIG. 45-49. FIG. 51 illustrates a bottom view of the exemplary embodiment of FIG. 45-50.

Figure 52:
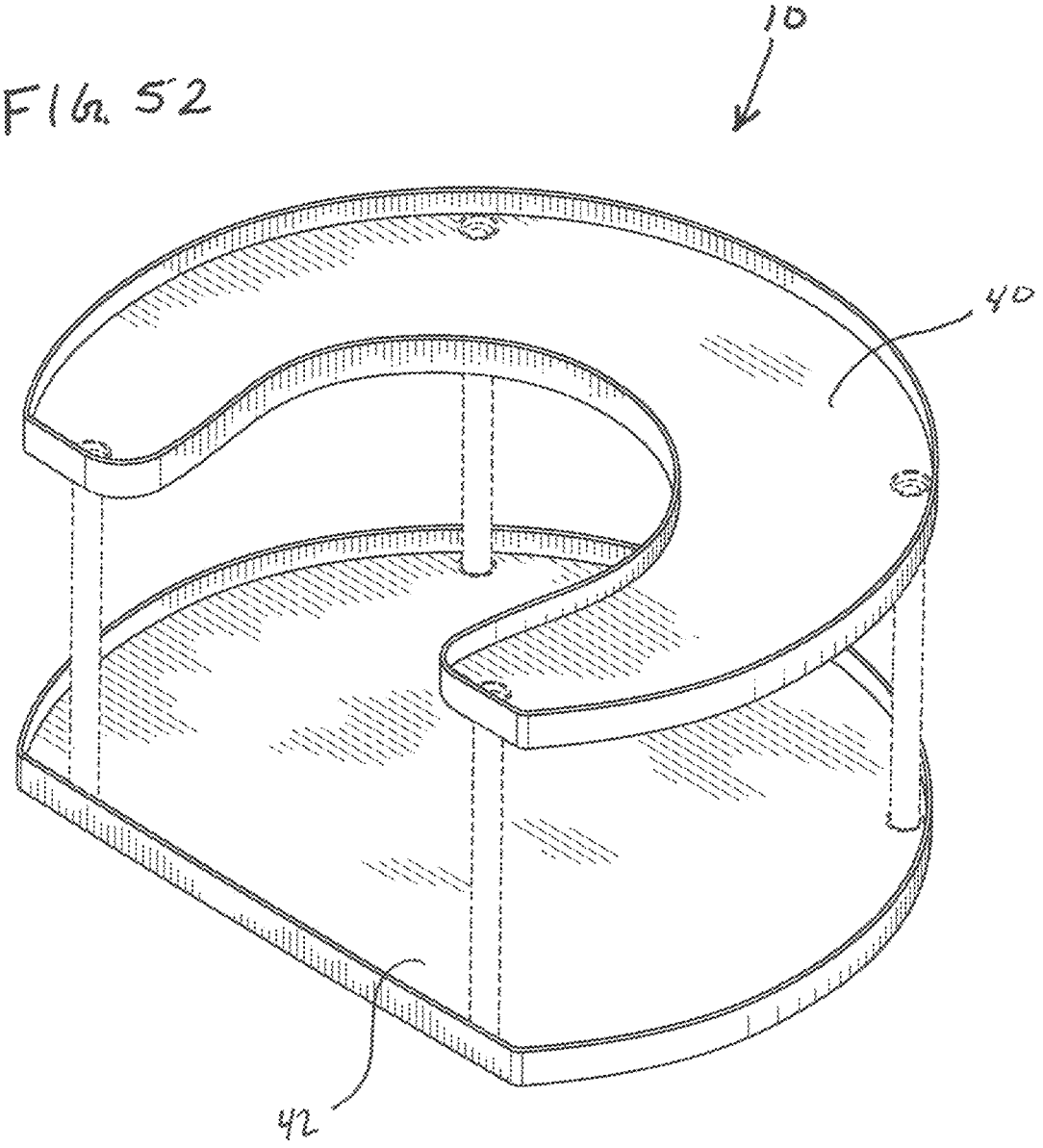
FIG. 52 illustrates a perspective view of an exemplary embodiment of the present invention showing an exemplary two shelf embodiment.

FIG. 52 illustrates a perspective view of an exemplary embodiment of the present invention showing an exemplary two shelf embodiment. This embodiment illustrates a configuration in which there is only a single swiveling spinner and, since the top shelf is of a different configuration than the bottom shelf, taller items (or stacked items) may be placed on the lower shelf.

Figure 53:
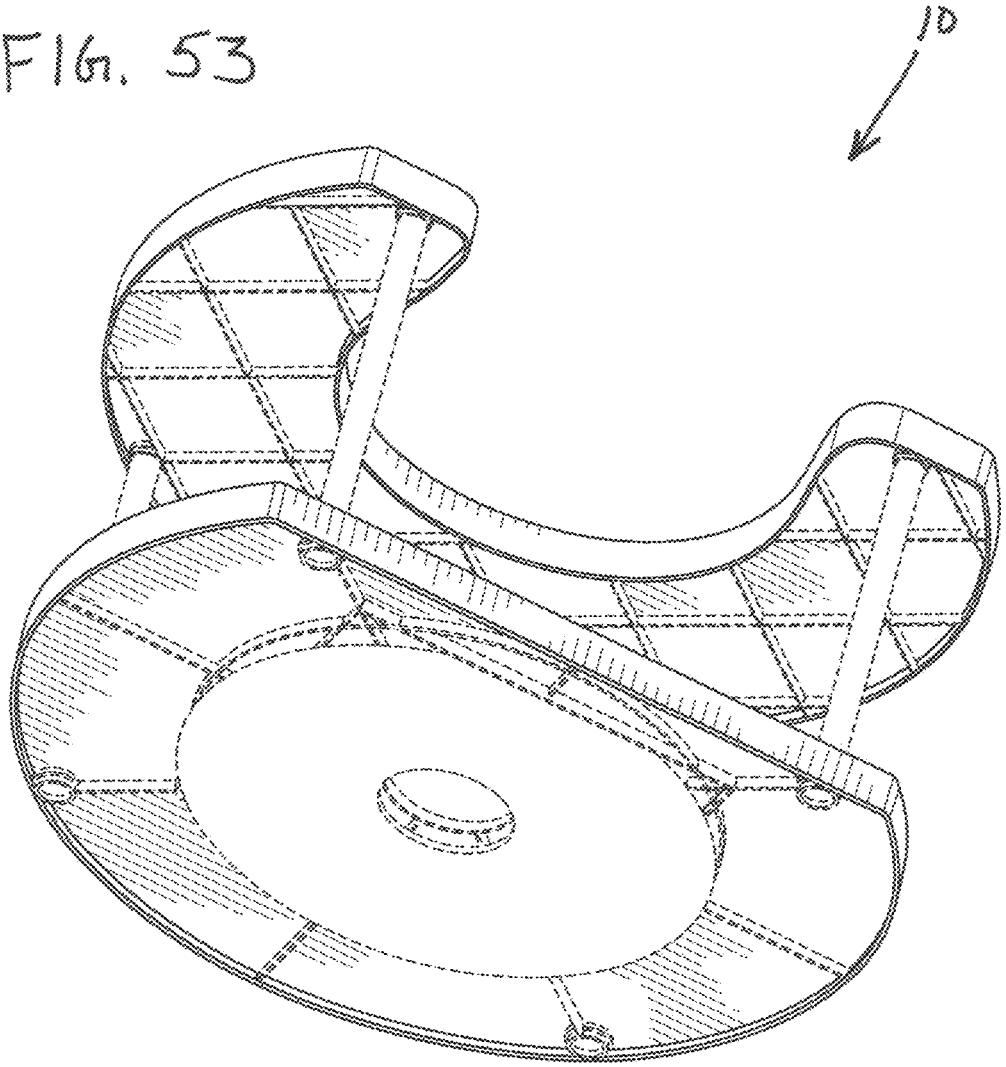
FIG. 53 illustrates a bottom perspective view of the exemplary embodiment of FIG. 52.
Figure 54:
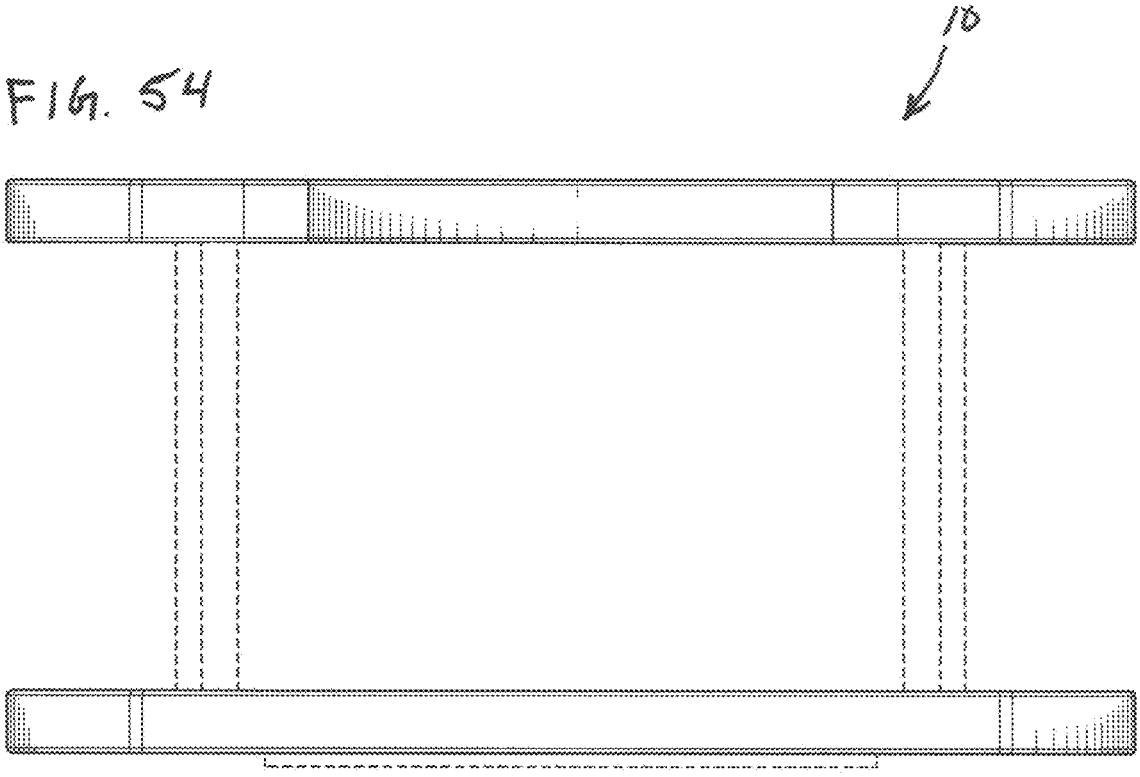
FIG. 54 illustrates a front view of the exemplary embodiment of FIG. 52-53.
Figure 55:
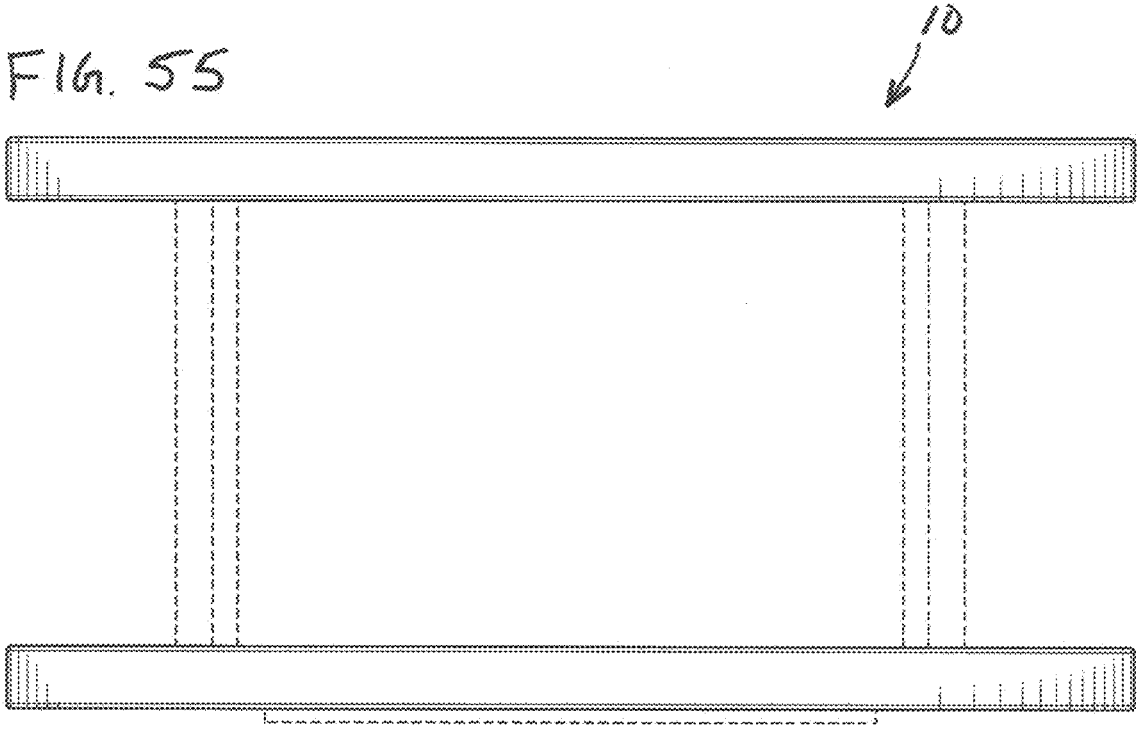
FIG. 55 illustrates a rear view of the exemplary embodiment of FIG. 52-54.
Figure 56:
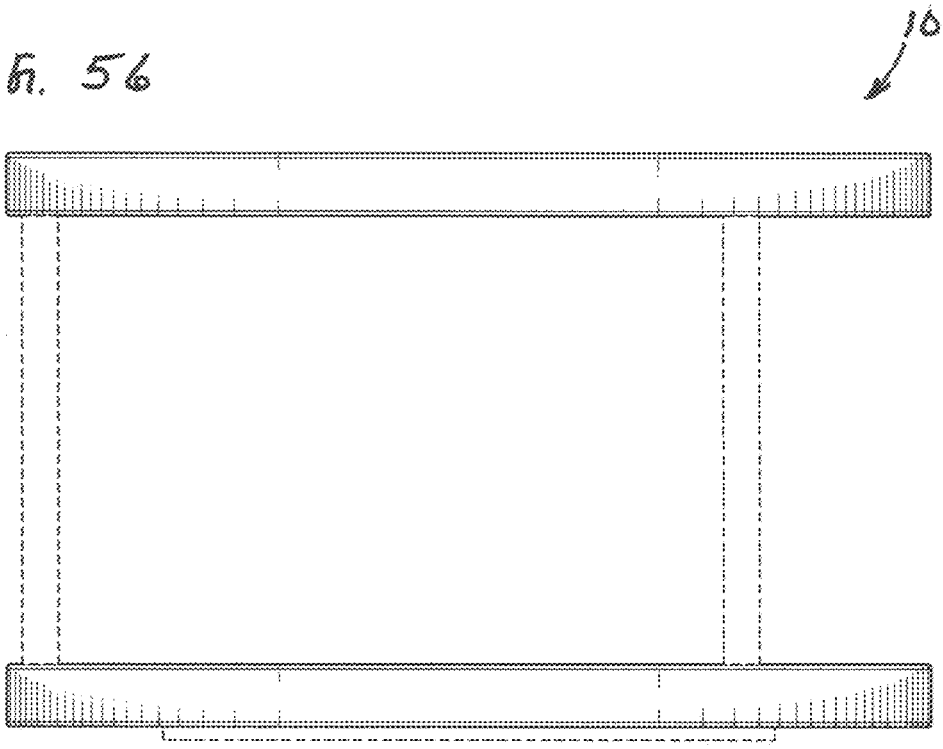
FIG. 56 illustrates a first side view of the exemplary embodiment of FIG. 52-55.
Figure 57:
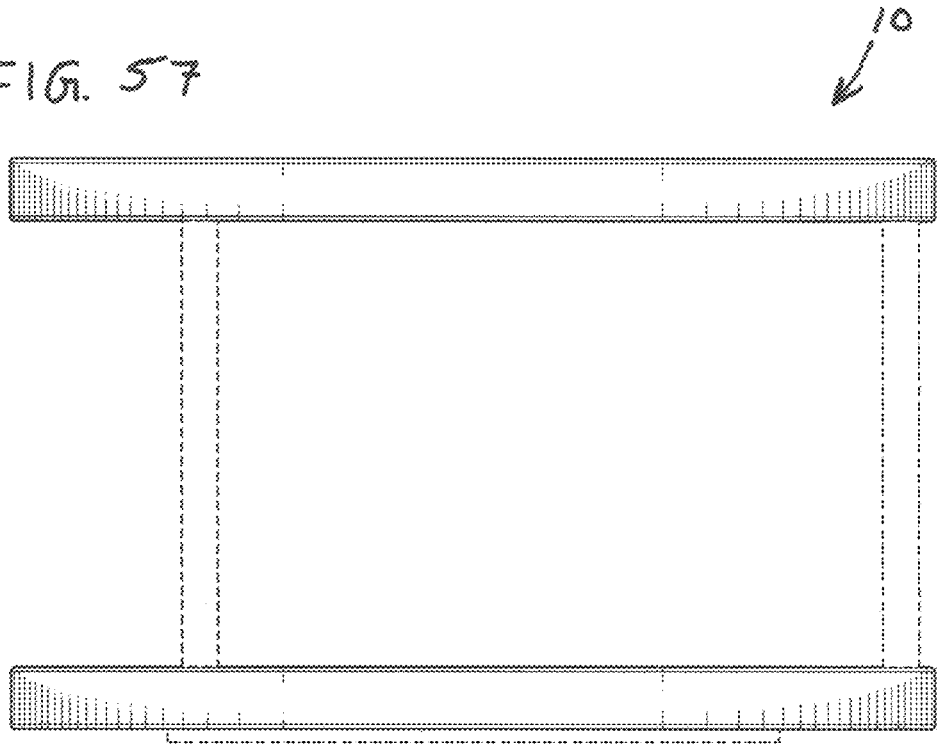
FIG. 57 illustrates a second side view of the exemplary embodiment of FIG. 52-56.
Figure 58:
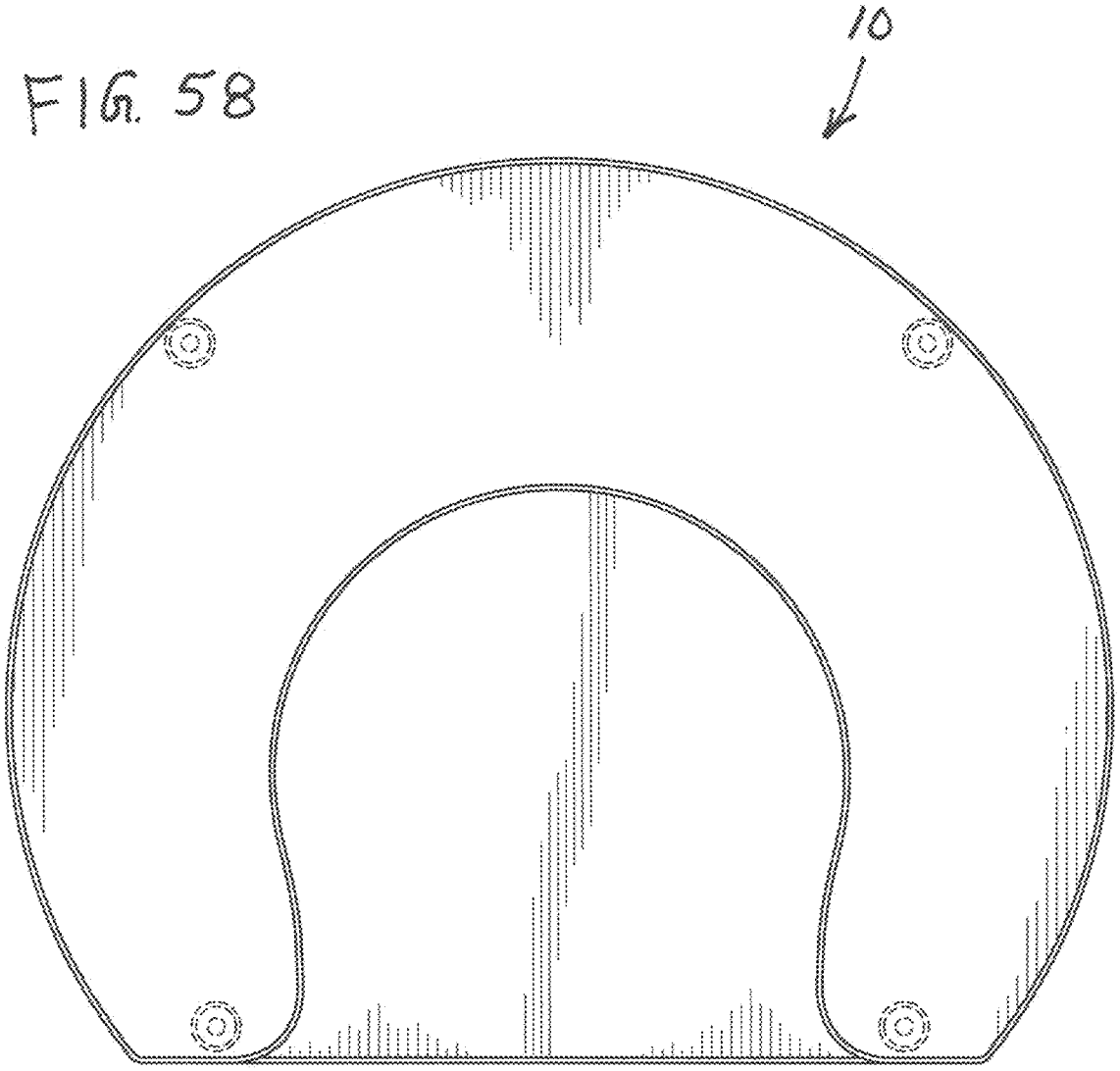
FIG. 58 illustrates a top view of the exemplary embodiment of FIG. 52-57.
Figure 59:
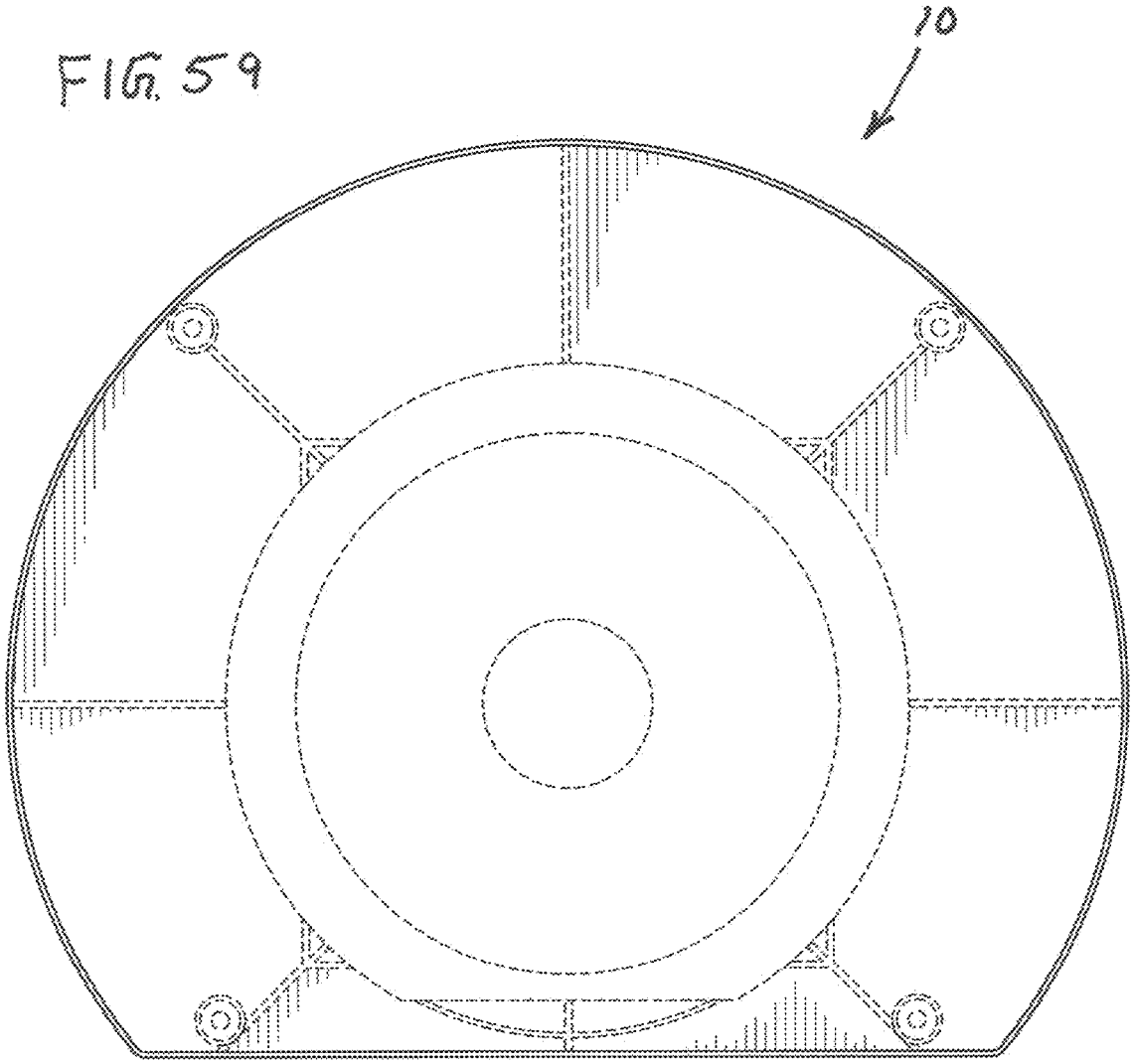
FIG. 59 illustrates a bottom view of the exemplary embodiment of FIG. 52-58.

FIG. 53 illustrates a bottom perspective view of the exemplary embodiment of FIG. 52. FIG. 54 illustrates a front view of the exemplary embodiment of FIG. 52-53. FIG. 55 illustrates a rear view of the exemplary embodiment of FIG. 52-54. FIG. 56 illustrates a first side view of the exemplary embodiment of FIG. 52-55. FIG. 57 illustrates a second side view of the exemplary embodiment of FIG. 52-56. FIG. 58 illustrates a top view of the exemplary embodiment of FIG. 52-57. FIG. 59 illustrates a bottom view of the exemplary embodiment of FIG. 52-58.

Figure 60:
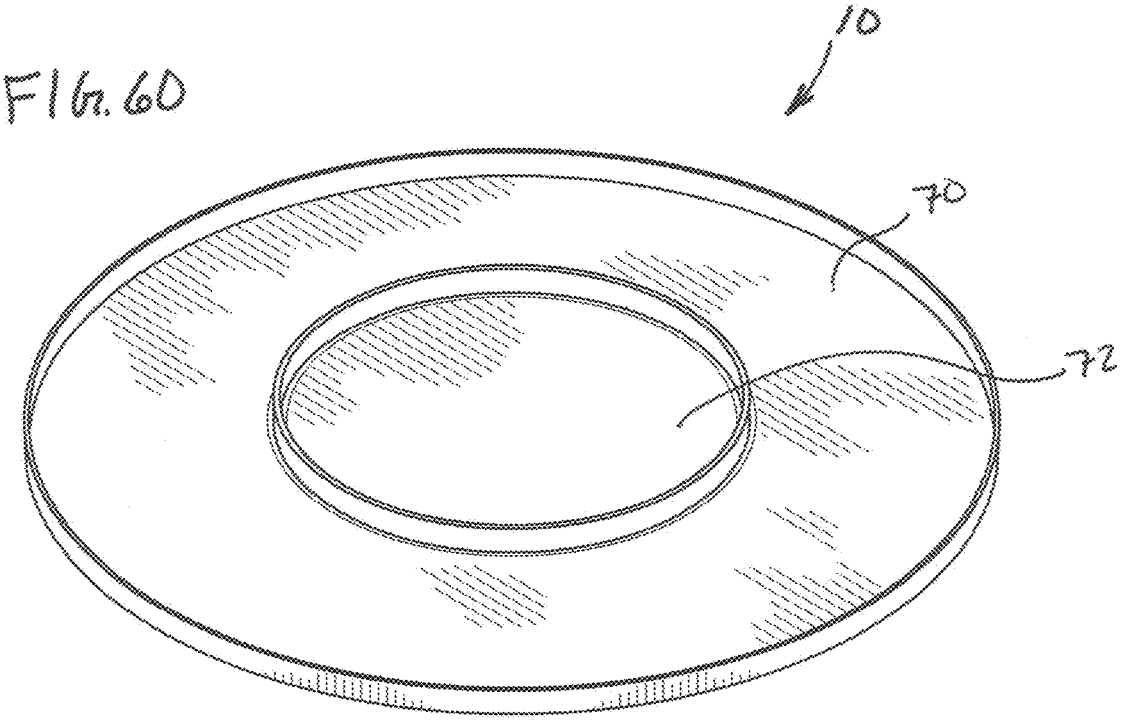
FIG. 60 illustrates a perspective view of an exemplary embodiment of the present invention showing an exemplary one shelf embodiment.

FIG. 60 illustrates a perspective view of an exemplary embodiment of the present invention showing an exemplary one shelf embodiment. In this mechanism, lower shelf 70 and smaller swiveling spinner portion 72 have coaxial axes. Note that the two spinner mechanism may be independent of each other or linked. Note that the shape of lower shelf/shelf 70 and swiveling spinner 72 are each round in this embodiment though they may be of other geometric and non-geometric shapes and do not have to have the same shape.

Figure 61:
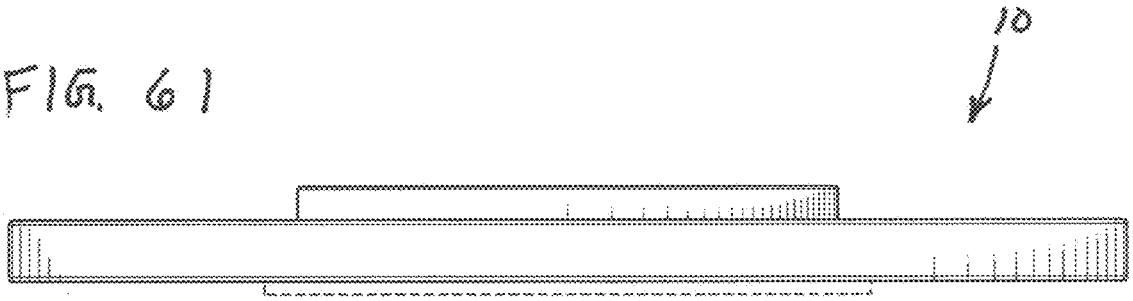
FIG. 61 illustrates a front view of the exemplary embodiment of FIG. 60.
Figure 62:
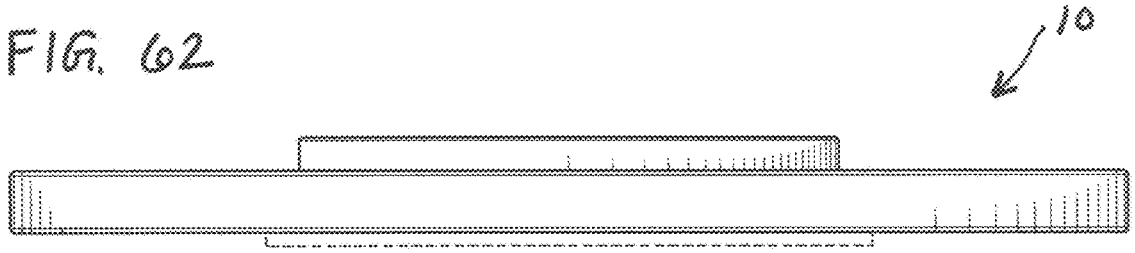
FIG. 62 illustrates a rear view of the exemplary embodiment of FIG. 60-61.
Figure 63:
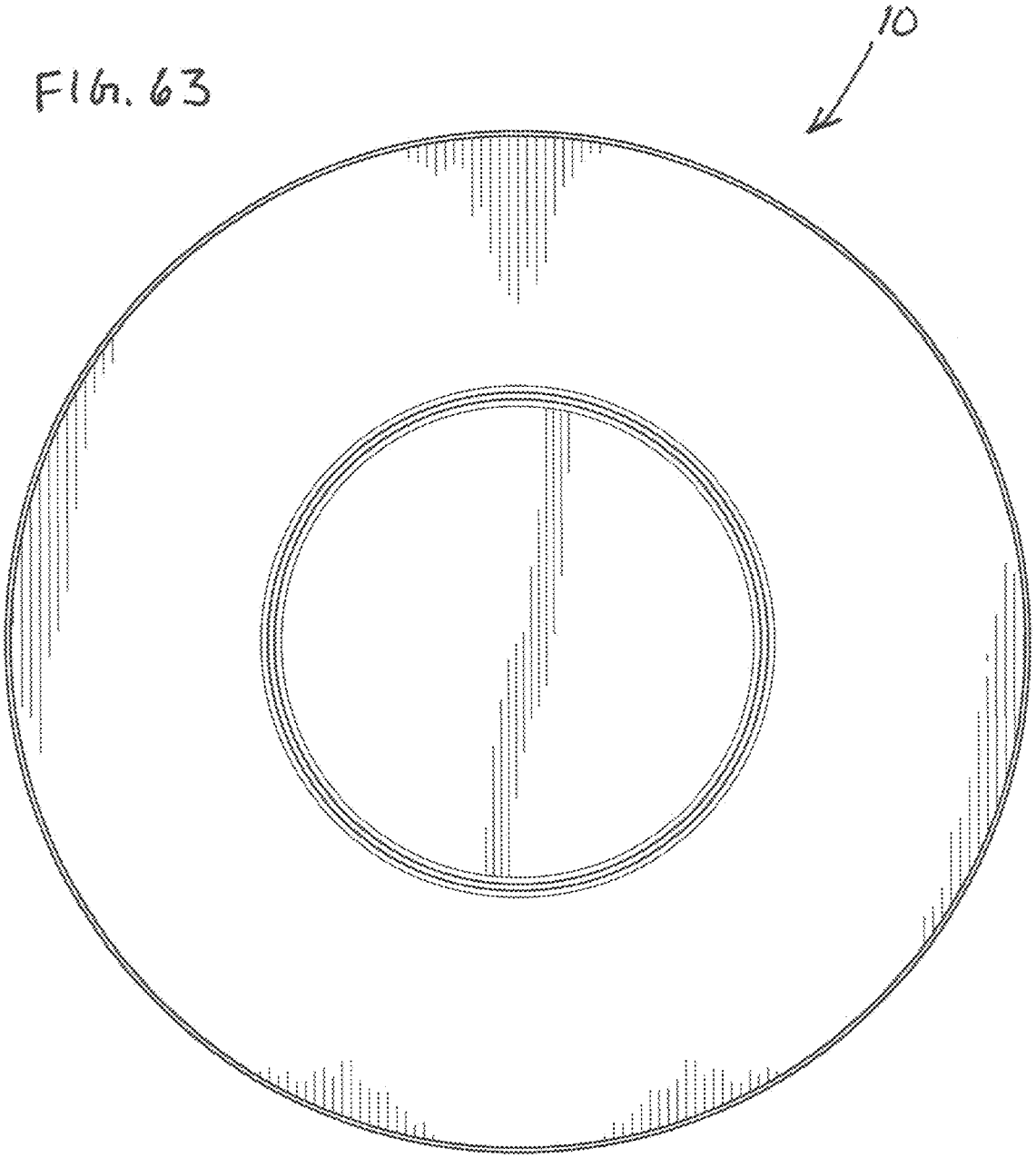
FIG. 63 illustrates a top view of the exemplary embodiment of FIG. 60-62.
Figure 64:
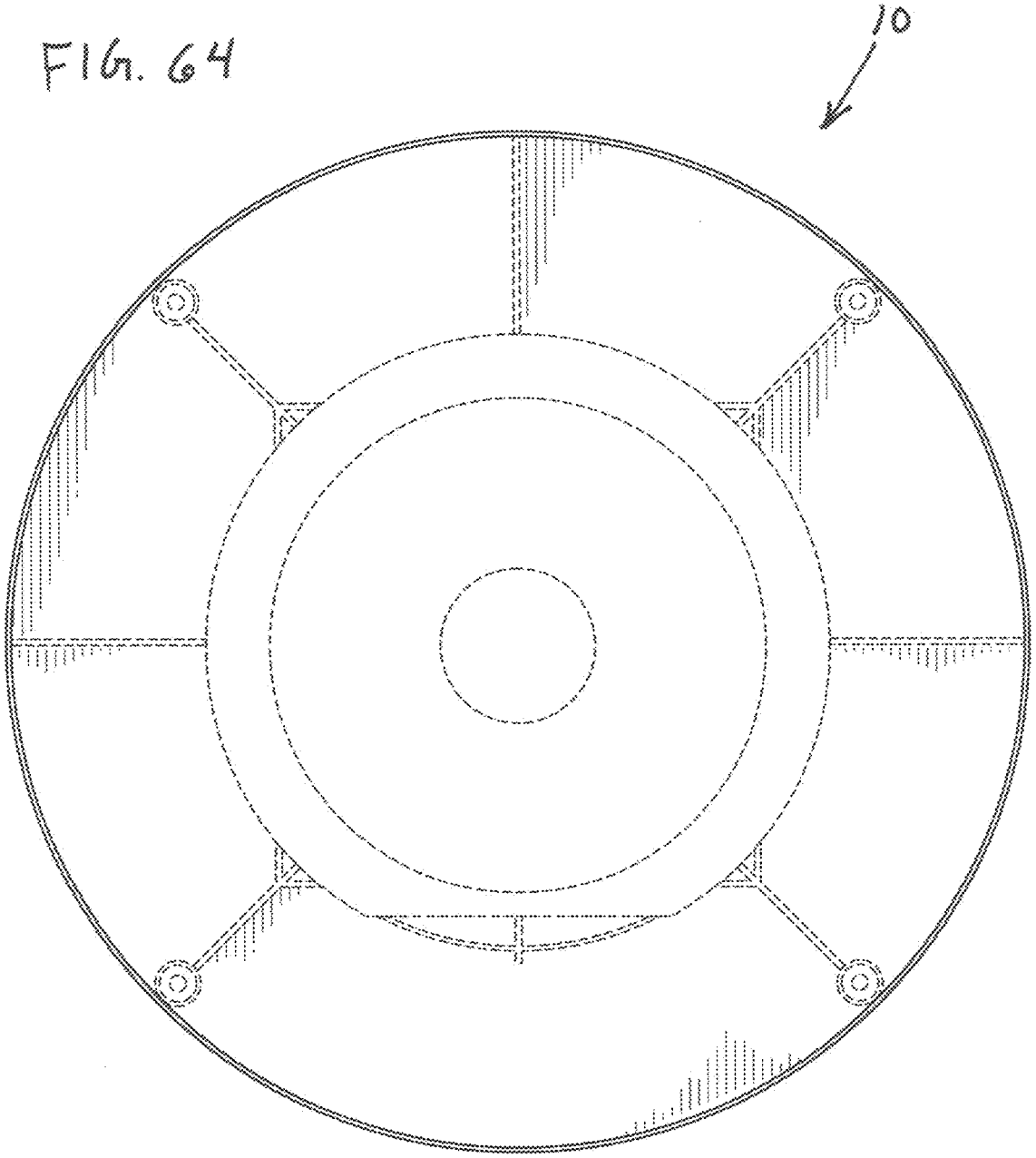
FIG. 64 illustrates a bottom view of the exemplary embodiment of FIG. 60-63.

FIG. 61 illustrates a front view of the exemplary embodiment of FIG. 60. FIG. 62 illustrates a rear view of the exemplary embodiment of FIG. 60-61. FIG. 63 illustrates a top view of the exemplary embodiment of FIG. 60-62. FIG. 64 illustrates a bottom view of the exemplary embodiment of FIG. 60-63.

Figure 65:
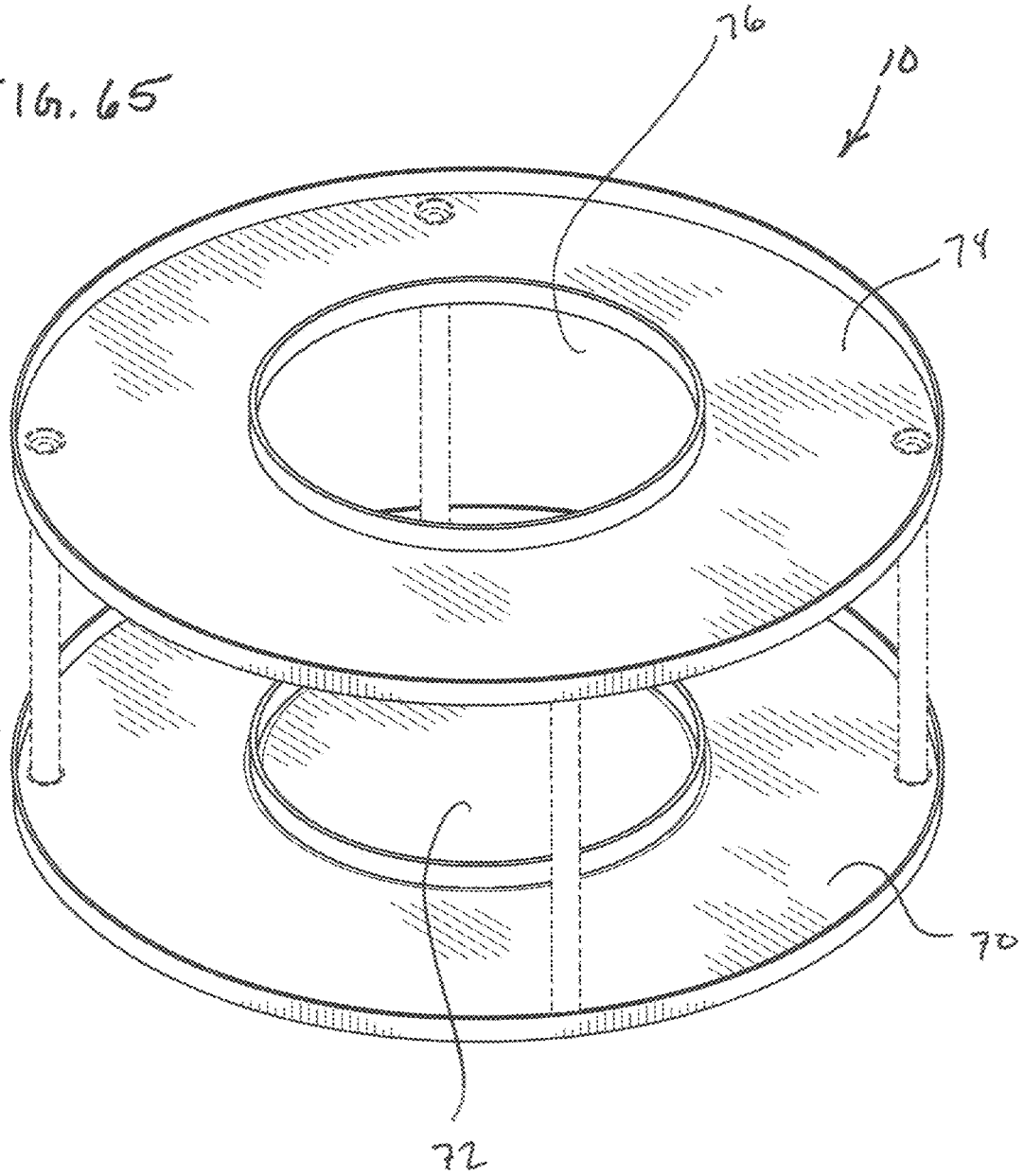
FIG. 65 illustrates a perspective view of an exemplary embodiment of the present invention showing an exemplary two shelf embodiment.

FIG. 65 illustrates a perspective view of an exemplary embodiment of the present invention showing an exemplary two shelf embodiment. In this embodiment, lower shelf 70 has a centrally located (i.e., coaxial) swiveling spinner portion 72 and that upper shelf 74 has a hole/gap/space/void 76 such that taller/stacked/etc. items may be placed on spinner portion 72 and not be constrained by the lower portion/surface of upper shelf 74. Note that hole 76 in this embodiment is at least as large as the outer perimeter of swiveling spinner 72 such that there is no obstruction to for the goods as they are pivoted by swiveling spinner 72. In some embodiments, the hole may be even larger than the perimeter of swiveling spinner 72.

Figure 66:
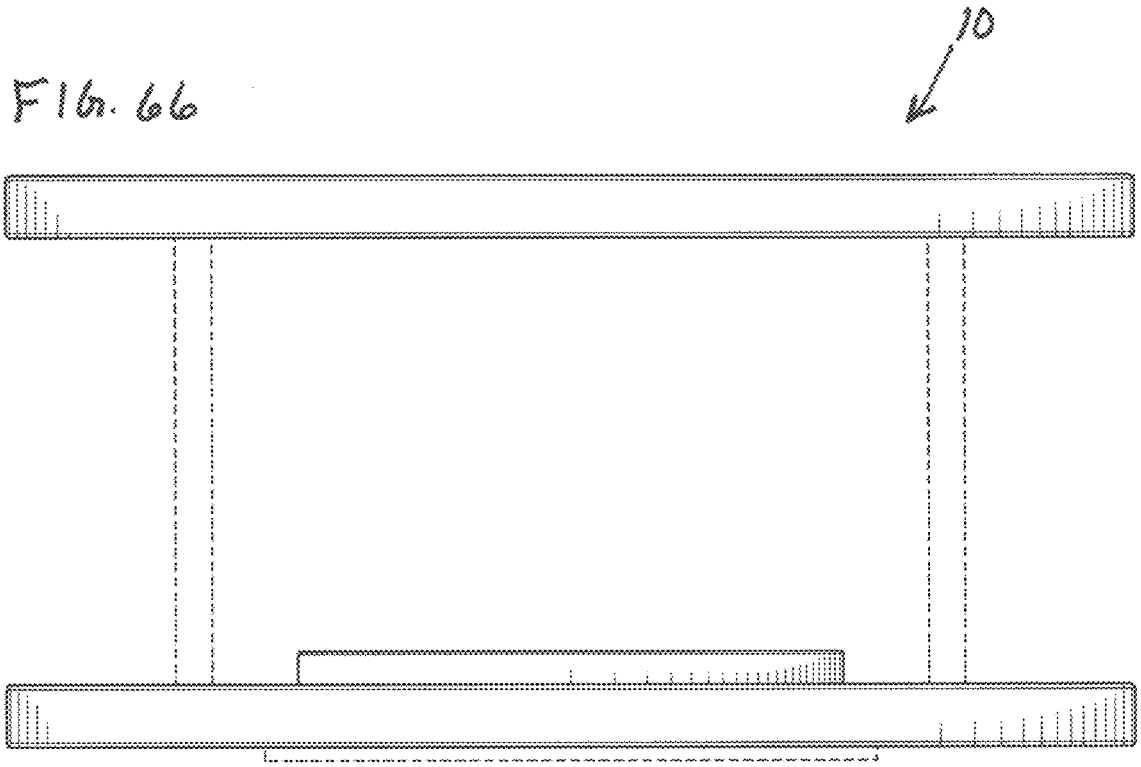
FIG. 66 illustrates a front view of the exemplary embodiment of FIG. 65.
Figure 67:
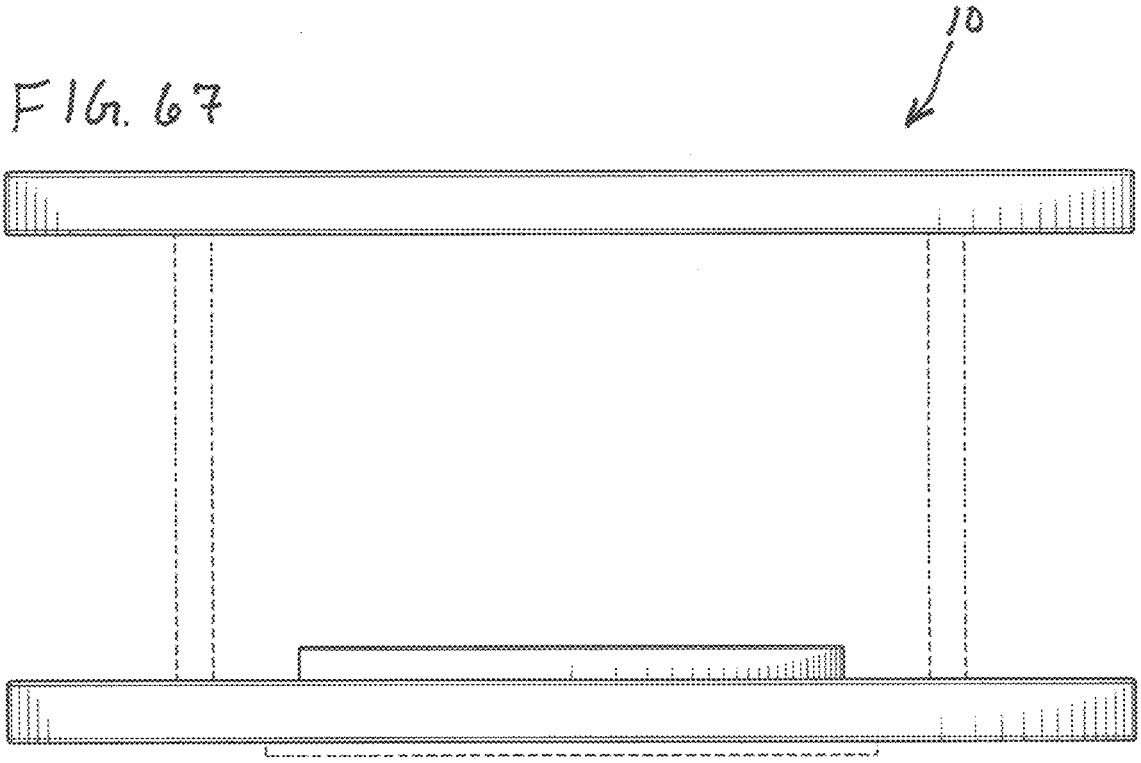
FIG. 67 illustrates a rear view of the exemplary embodiment of FIG. 65-66.
Figure 68:
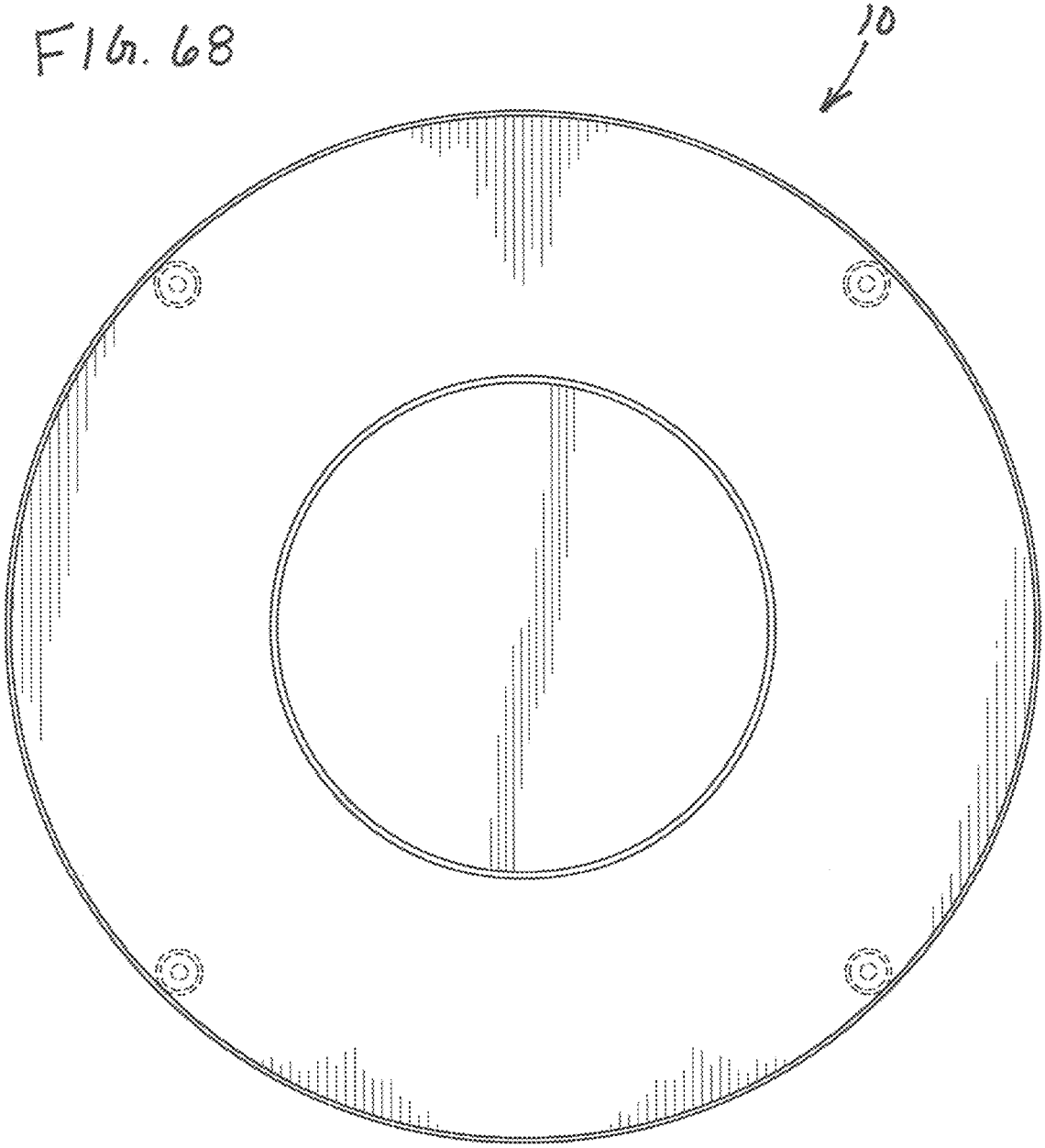
FIG. 68 illustrates a top view of the exemplary embodiment of FIG. 65-67.
Figure 69:
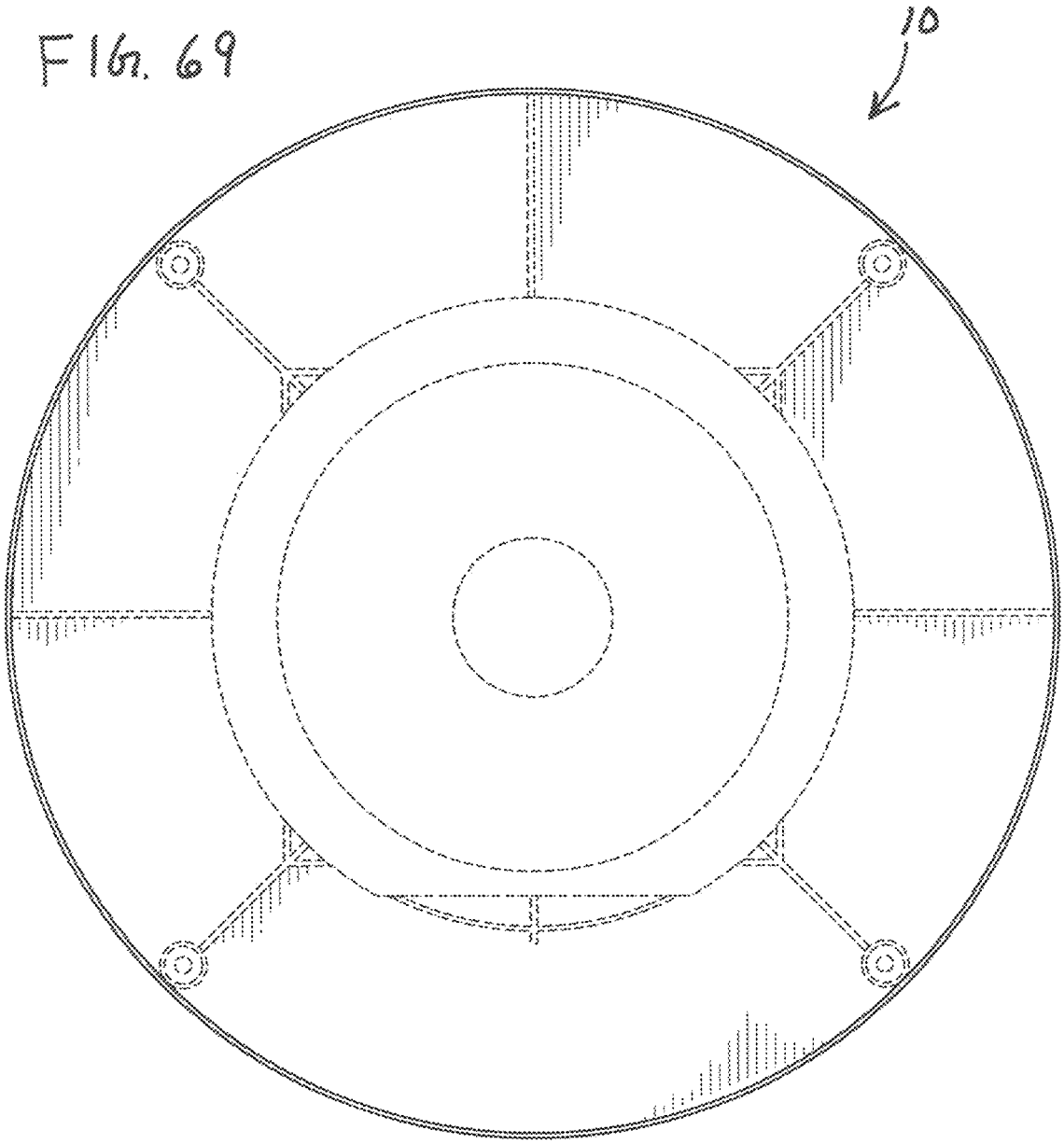
FIG. 69 illustrates a bottom view of the exemplary embodiment of FIG. 65-68.
Figure 20:
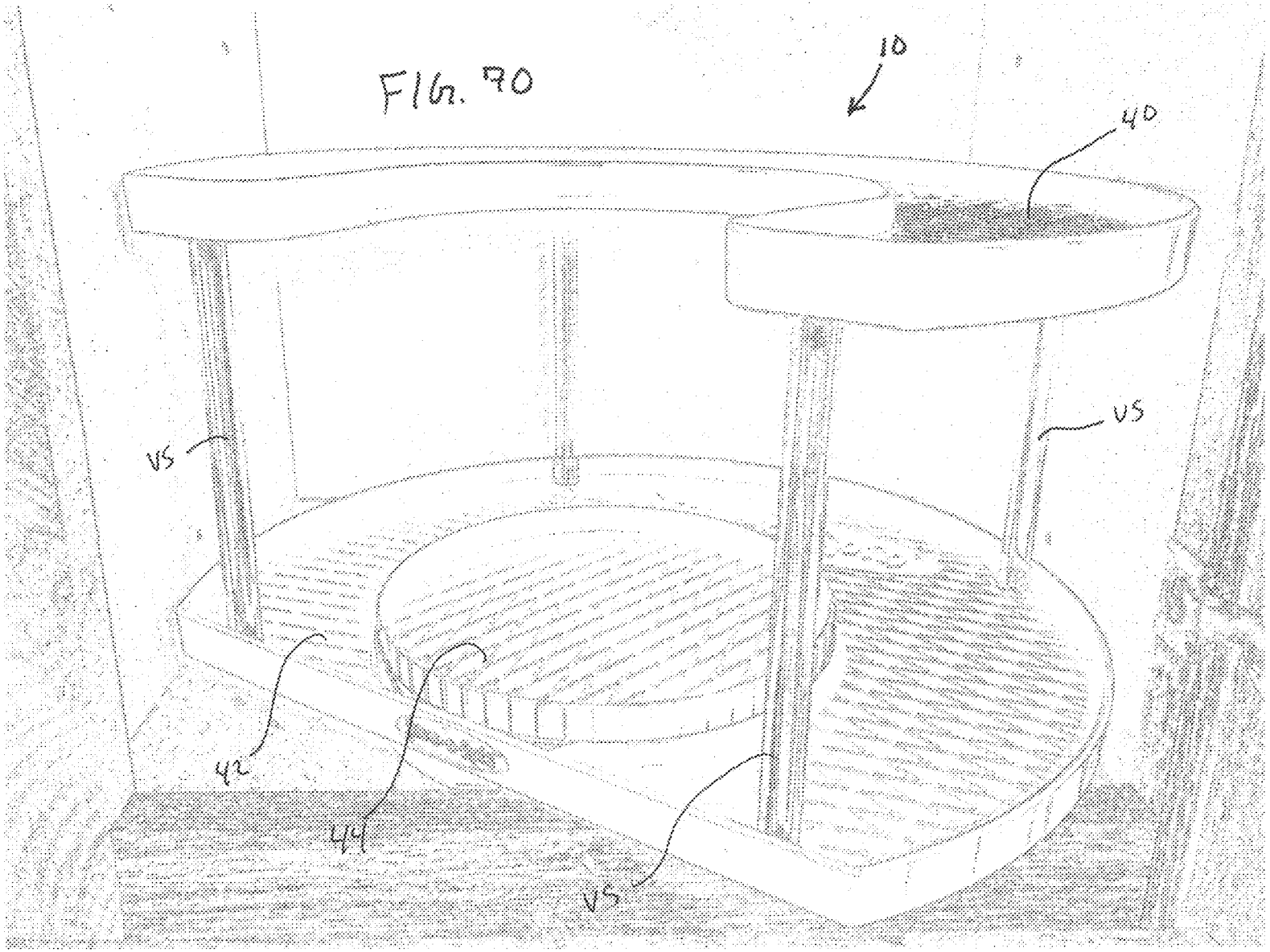

FIG. 66 illustrates a front view of the exemplary embodiment of FIG. 65. FIG. 67 illustrates a rear view of the exemplary embodiment of FIG. 65-66. FIG. 68 illustrates a top view of the exemplary embodiment of FIG. 65-67. FIG. 69 illustrates a bottom view of the exemplary embodiment of FIG. 65-68.

Figure 71:
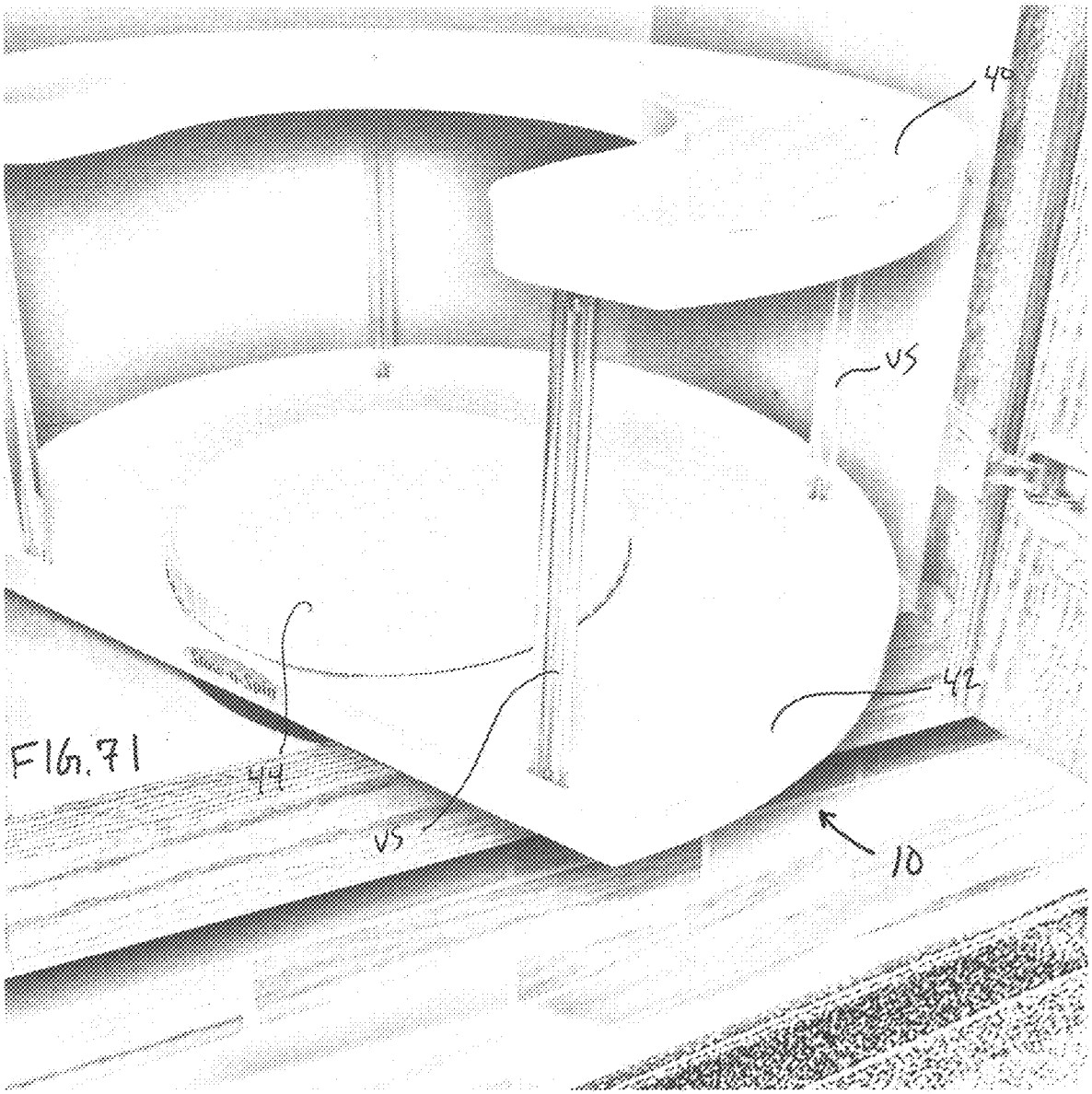
FIG. 71 illustrates a perspective view of the exemplary embodiment of FIG. 70.
Figure 22:
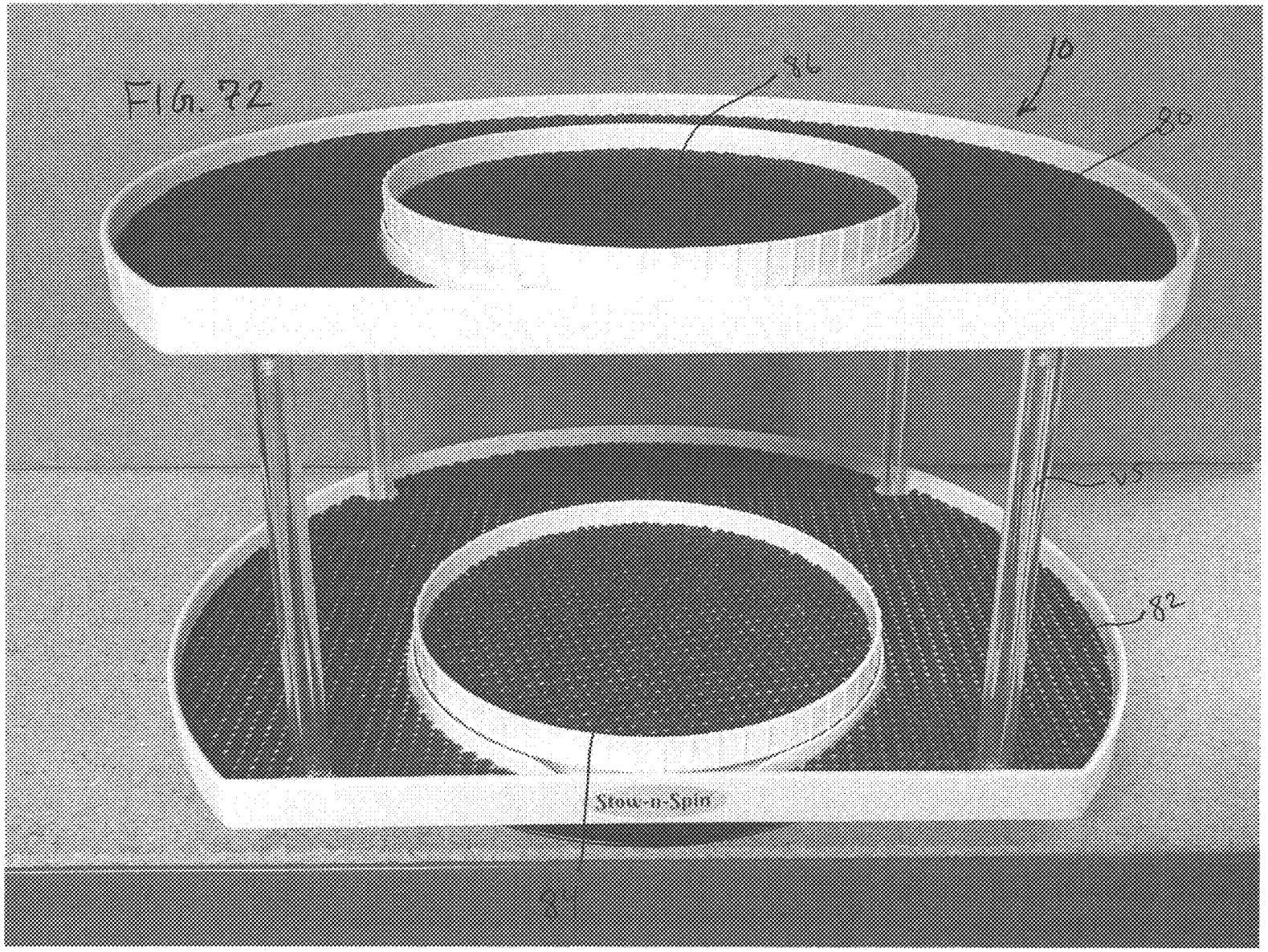

FIG. 70 illustrates a perspective view of an exemplary embodiment of the present invention showing an exemplary two shelf embodiment. FIG. 71 illustrates a perspective view of the exemplary embodiment of FIG. 70.

FIG. 72 illustrates a perspective view of an exemplary embodiment of the present invention showing an exemplary two shelf embodiment. In this embodiment, upper shelf 80 has a shape that is the same, or proportional to lower shelf 82 and each of shelves 80, 82 have one or more spinners, 84, 86 thereon. Note that in this embodiment, spinners 84, 86 are coaxial. In some embodiments, the spinners are not coaxial. Note that this embodiment is in place in a cabinet and that the only connection between the device and the cabinet is via the swiveling spinner under the lower shelf.

In some embodiments with more than one tray/shelf, the various components may be affixed together via screwed fasteners such that the device may be shipped to a consumer in a small package, and the consumer may due the final assembly utilizing screwed fasteners and the vertical supports. Such a system allows for shipment of a smaller package, and, thus reduced shipping charges as opposed to shipment of a fully assembled device.

In some embodiments, there may be one or more raised portions on the exterior side wall of the vertical wall portion of the device. Such raised portions can apply concentrated pressure/force if an article outside of the device is making contact with the device. Thus, when the tray is rotated, the raised portion comes in to contact with the offending article and provides a force to push the article away from the tray so that it is no longer impeding rotation (and use) of the tray/device. These raised portions may be small and extend over a very small length of the perimeter of the device. In some embodiments, the raised portion extends over less than five degrees of the arc of the curved portion. In some embodiments, the raised portions extend over less than two degrees of the arced portion of the curved portion.

Although various components of the present invention may be illustrated as being of a particular shape for convenience, such components may be of any suitable shape, configuration, orientation, etc.

While the specification has been described in detail with respect to specific embodiments thereof, it will be appreciated that those skilled in the art, upon attaining an understanding of the foregoing, may readily conceive of alterations to, variations of, and equivalents to these embodiments.

What is claimed is:

1. A shelving system device, said device comprising:

a lower shelf having a lower shelf top surface and a lower shelf bottom surface, a first swiveling spinner connected to said lower shelf bottom surface allowing said lower shelf to be pivoted about a first swiveling spinner axis, wherein said device is freestanding on a cabinet surface and there is no contact with any cabinet surface other than below said lower shelf, a second swiveling spinner which rotates independently from said first swiveling spinner, and at least one upper shelf above said lower shelf, and wherein said at least one upper shelf is supported by two or more spacers with a first end of each of said spacers is in contact with said at least one upper shelf and a respective distal end of each of said spacers is in contact with said lower shelf, and said second swiveling spinner has an outer edge perimeter and at least one of said at least one upper shelf has a cutout above said second swiveling spinner wherein said cutout is at least as large as said outer edge perimeter of said second swiveling spinner.

2. The device of claim 1, wherein said first spinner is positioned below said lower shelf bottom surface.

3. The device of claim 1, wherein said second swiveling spinner is located on said lower shelf top surface.

4. The device of claim 1, wherein said lower shelf has geometric center and a lower shelf axis through said geometric center located one half of the distance measured from a front of said lower shelf to a rear of said lower shelf and one half of the distance between a right hand end of said lower shelf and a left hand end of said lower shelf, said second swiveling spinner has a second swiveling spinner axis, and said first swiveling spinner axis is not coaxial with said lower shelf axis.

5. The device of claim 3, wherein said lower shelf has geometric center and a lower shelf axis through said geometric center and said lower shelf axis is not coaxial with said second swiveling spinner axis.

6. The device of claim 3, wherein said second swiveling spinner has a second swiveling spinner axis, and said second swiveling spinner axis is parallel with said first swiveling spinner axis.

7. The device of claim 1, wherein said at least one upper shelf has a different shape than said lower shelf.

8. The device of claim 1, wherein at least one of said at least one upper shelf is "C" shaped.

9. The device of claim 1, wherein said lower shelf has geometric center and a lower shelf axis through said geometric center located one half of the distance measured from a front of said lower shelf to a rear of said lower shelf and one half of the distance between a right hand end of said lower shelf and a left hand end of said lower shelf, and said first swiveling spinner axis is not coaxial with said lower shelf axis.

10. The device of claim 1, wherein said lower shelf is "D" shaped.

11. A shelving system device, said device comprising:

a lower shelf having a lower shelf top surface and a lower shelf bottom surface, a first swiveling spinner connected to said lower shelf bottom surface allowing said lower shelf to be pivoted about a first swiveling spinner axis, at least one upper shelf above said lower shelf, and wherein a second swiveling spinner is located on said lower shelf top surface and said second swiveling spinner has a second swiveling spinner axis, and said lower shelf is "D" shaped having a straight or flat portion that is generally straight and a curved portion which is generally arced, and said second swiveling spinner axis is parallel to said first swiveling spinner axis and said second swiveling spinner axis is closer to said straight portion than said first swiveling spinner axis.

12. The device of claim 11, wherein said device is freestanding on a cabinet surface and there is no contact with any cabinet surface other than below said lower shelf.

13. The device of claim 11, wherein said at least one upper shelf has a different shape than said lower shelf.

14. The device of claim 11, wherein at least one of said at least one upper shelf is "C" shaped.

* * * * *